US005081455A

United States Patent [19]

Inui et al.

[11] Patent Number: 5,081,455

[45] Date of Patent: Jan. 14, 1992

[54] ELECTROMAGNETIC WAVE ABSORBER

[75] Inventors: Tetsuji Inui; Kenichi Hatakeyama; Satoshi Yoshiuchi; Takashi Harada; Takashi Kizaki, all of Tokyo, Japan

[73] Assignee: NEC Corporation, Tokyo, Japan

[21] Appl. No.: 293,495

[22] Filed: Jan. 4, 1989

[30] Foreign Application Priority Data

| | | | |
|---|---|---|---|
| Jan. 5, 1988 | [JP] | Japan | 63-939 |
| Jan. 21, 1988 | [JP] | Japan | 63-11957 |
| Jun. 29, 1988 | [JP] | Japan | 63-164041 |
| Jun. 29, 1988 | [JP] | Japan | 63-164042 |
| Jun. 29, 1988 | [JP] | Japan | 63-164043 |
| Jun. 29, 1988 | [JP] | Japan | 63-164044 |
| Jun. 30, 1988 | [JP] | Japan | 63-164330 |
| Jun. 30, 1988 | [JP] | Japan | 63-164331 |
| Jun. 30, 1988 | [JP] | Japan | 63-164332 |
| Jun. 30, 1988 | [JP] | Japan | 63-164333 |

[51] Int. Cl.[5] ..... H01Q 17/00

[52] U.S. Cl. ..... 342/1; 342/4; 342/3

[58] Field of Search ..... 342/1, 2, 3, 4

[56] References Cited

U.S. PATENT DOCUMENTS

| | | | |
|---|---|---|---|
| 2,464,006 | 3/1949 | Tiley | 342/4 |
| 2,822,539 | 2/1958 | McMillan | 342/1 |
| 2,870,439 | 1/1959 | Stinehelfer | 342/4 |
| 2,977,591 | 3/1961 | Tanner | 342/1 |
| 2,992,425 | 7/1961 | Pratt | 342/1 |
| 3,508,265 | 4/1970 | Ellis | 342/1 |
| 3,540,047 | 11/1970 | Walser et al. | 342/1 |
| 3,568,195 | 3/1971 | Wesch | 342/1 |
| 3,599,210 | 8/1971 | Stander | 342/2 |
| 3,623,099 | 11/1971 | Suetake | 342/4 |
| 3,631,492 | 12/1971 | Suetake et al. | 342/4 |
| 3,721,982 | 3/1973 | Wesch | 342/1 |
| 3,733,606 | 5/1973 | Johannson | 342/3 |
| 3,737,903 | 6/1973 | Suetake et al. | 342/1 |
| 3,836,967 | 9/1974 | Wright | 342/4 |
| 3,887,920 | 6/1975 | Wright et al. | 342/1 |
| 3,938,152 | 2/1976 | Grimes et al. | 342/1 |
| 4,001,827 | 1/1977 | Wallin et al. | 342/3 |
| 4,012,738 | 3/1977 | Wright | 342/1 |
| 4,034,375 | 7/1977 | Wallin | 342/3 |
| 4,038,660 | 7/1977 | Connolly et al. | 342/1 |
| 4,064,305 | 12/1977 | Wallin | 342/3 |
| 4,118,704 | 10/1978 | Ishino et al. | 342/4 |
| 4,164,718 | 8/1979 | Iwasaki | 342/4 X |
| 4,439,768 | 3/1984 | Ebneth et al. | 342/5 |
| 4,522,890 | 6/1985 | Volkers et al. | 342/1 X |
| 4,538,151 | 8/1985 | Hatakeyama et al. | 342/1 |
| 4,539,433 | 9/1985 | Ishino et al. | 342/1 X |
| 4,572,960 | 2/1986 | Ebneth et al. | 342/1 X |
| 4,725,490 | 2/1988 | Goldberg | 342/1 X |
| 4,728,554 | 3/1988 | Goldberg et al. | 342/1 X |

FOREIGN PATENT DOCUMENTS 5810902 1/1983 Japan .

OTHER PUBLICATIONS

White, EMC Handbook, vol. 3, Interference Control Technologies, Inc., Don White Consultants, pp. 10 0–10 11 (6 pages), 1973, Chapter 10.

Inui et al., "Newly Developed Non-Woven Fabric EM-Wave Absorber", 1989 International Symposium on Electromagnetic Compatibility, Sep. 8-10, 1989, pp. 775-779.

*Primary Examiner*—John B. Sotomayor

*Attorney, Agent, or Firm*—Burns, Doane, Swecker & Mathis

[57] ABSTRACT

For reduction in occupation space without sacrifice of the responsible broad bandwidth, an electromagnetic wave absorber for electromagnetic waves is provided with an absorbing sheet formed of a non-woven fabric containing conductive fibers mixed with insulative fibers, and each of the conductive fibers is selected from the group consisting of a metal fiber or a resin fiber coated with a conductive material.

19 Claims, 27 Drawing Sheets

ELECTROMAGNETIC WAVE ABSORBER

FIELD OF THE INVENTION

This invention relates to an electromagnetic wave absorber and, more particularly, to an electromagnetic absorber which is responsive to a broad bandwidth.

BACKGROUND OF THE INVENTION

The electromagnetic wave absorbers are grouped by various aspects such as, for example, principles, structures or configurations and respectively have advantages in the operation properties such as a responsive frequency range or the amount of absorption, good weather durability or easy for fabrication. The electromagnetic wave absorbers are generally evaluated in both of the electromagnetic wave absorbing properties and the frequency band range responsive thereto. In detail, when an electromagnetic wave 1 is obliquely radiated to the electromagnetic wave absorber 2 laminated on a metal plate 3 at angle a1 with respect to the perpendicular plane 4, the electromagnetic wave 1 is reflected from the electromagnetic wave absorber 2 at angle a2 with respect to the perpendicular plane 4, thereby forming the reflection 5. The electromagnetic wave absorbing properties are defined by measuring the amount of decay between the incident electromagnetic wave 1 and the reflection 5. If the angle a1 is equal to zero, the electromagnetic wave absorbing property is called the perpendicular incident property, however, others are called as the oblique incident properties. If the angle a1 is increased in value, the electromagnetic wave absorbing properties are deviated from those at zero. In practical applications, the electromagnetic waves are radiated thereto at various angles, then the oblique incident properties are more important than the perpendicular incident property for the electromagnetic wave absorber. Moreover, since the electromagnetic waves are radiated thereto at various frequencies, it is preferable for practical applications that the electromagnetic wave absorber be operative with all of the frequencies. However, the prior-art electromagnetic wave absorbers are limited to a relatively narrow range. Electromagnetic wave absorbers are sometimes classified into the broad bandwidth type and the narrow bandwidth type with the criterion of the specific bandwidth of 20%.

If the electromagnetic wave absorbers are grouped by the configurations, they would be largely divided into a sheet-shape group and a pyramid-shape group. The former group, i. e., the sheet-shape group, is small in thickness and has a flat plane surface, and, for this reason, the electromagnetic wave absorbers of this group are relatively easy for application. The narrow bandwidth type and tend to drastically deteriorate in the oblique incident properties when the incident angle is increased. The electromagnetic wave absorbers of rubber-ferrite system, ferrite-tile system, rubber-carbon system, urethane-carbon system would be classified into the sheet-shape group. The ferrite containing electromagnetic wave absorber is relatively broad in responsive bandwidth. However, it is not enough to use in an electromagnetic wave shielding room because of the insufficient oblique incident properties. In detail, assuming now that a radiation source 6 of electromagnetic waves is placed in an electromagnetic shielding room 7 defined by an electromagnetic wave absorbers 8*a*, 8*b*, 8*c* and 8*d* as well as a metal floor 8*e* as shown in FIGS. 2 and 3, the electromagnetic waves 9 are radiated from the source 6 in various directions. Some components 9 of the electromagnetic waves directly proceed toward a receiver 10. However, the other components 11 are reflected from the electromagnetic wave absorber 8. In general, it is preferable in the electromagnetic wave shielding room to allow the components directly proceeding and reflected from the metal floor to arrive at the receiver 10. Then, the other components reflected from the electromagnetic wave absorbers 8*a* to 8*d* should be decreased to be as small as possible.

In this situation, the the electromagnetic wave absorber 8*c* is expected to be superior in the perpendicular incident absorbing property, however, it is desirable for the other electromagnetic wave absorbers 8*a* and 8*d* to be superior in the oblique incident absorbing properties. As to the electromagnetic absorber 8*b*, the components fall in not only the perpendicular direction but also various oblique directions, and, for this reason, the electromagnetic wave absorber 8*b* is expected to be superior in all of the electromagnetic wave absorbing properties. However, the electromagnetic wave absorbers 8*a* and 8*d* are designed to be similar in absorbing properties to the electromagnetic wave absorbers 8*c*, because no electromagnetic wave absorber of the sheet-shape type is sufficient in the oblique incident properties. This results in deterioration in electromagnetic wave shielding characteristics such as the site-attenuation properties. The perpendicular incident absorbing property is deteriorated by decreasing the electromagnetic wave in frequency, and, accordingly, the oblique incident properties are also deteriorated with the frequency.

On the other hand, the later group or the pyramid-shape group is of the broad bandwidth type due to the complicated surface thereof, and, for this reason, the electromagnetic wave absorbers of this group effectively absorb the electromagnetic waves radiated at various oblique incident angles. However, since the pyramid protrusions should be at least a quarter of the wavelength in length, the electromagnetic wave absorbers are liable to be large in size and, accordingly, inconvenient in usage. For example, when the pyramid-shape electromagnetic wave absorber is applied to building an electromagnetic wave shielded room, the pyramid-shaped electromagnetic wave absorber reduces the size of shielding room.

SUMMARY OF THE INVENTION

It is therefor an important object of the present invention to provide an electromagnetic wave absorber which occupies a relatively small space without sacrifice of the responsible broad bandwidth.

It is another important object of the present invention to provide a process of fabricating the electromagnetic wave absorber.

In accordance with another aspect of the present invention, there is provided an electromagnetic wave absorber for electromagnetic waves comprising an absorbing sheet formed of a non-woven fabric containing conductive fibers mixed with insulative fibers. Each of the conductive fibers is formed with a metal fiber or a resin fiber coated with a conductive material.

In accordance with another aspect of the present invention, there is provided an electromagnetic wave absorber provided with at least one electromagnetic wave absorbing unit, the electromagnetic wave absorbing unit comprising a) a low loss retainer having an incident surface, electromagnetic waves being radiated across the incident surface, the electromagnetic waves absorbed by the electromagnetic waves absorbing unit having respective wavelengths, and b) a plurality of high loss strips provided in the low loss retainer and arranged on a plane in parallel to the incident surface in such a manner as to be spaced from one another, each of the high loss strips having a thickness less than about 10% of each wavelength, a width greater than about 10% of each wavelength but less than ten times each wavelength and a length larger in value than the width.

In accordance with still another aspect of the present invention, there is provided an electromagnetic wave absorber for electromagnetic waves fabricated on a metal plate, comprising: a) retainer member having a wall portion defining a hollow space, the wall portion having a thickness less than wavelengths of the electromagnetic waves absorbed for allowing the retainer member to be transparent to the electromagnetic waves; and b) a mixture of conductive fibers and insulative fibers filling the hollow space, the conductive fibers of the mixture being oriented in most of the directions with respect to the electromagnetic waves incident thereto.

In accordance with still another aspect of the present invention, there is provided an electromagnetic wave absorber for electromagnetic waves comprising an absorbing sheet structure formed of a non-woven fabric containing conductive fibers mixed with insulative fibers, and high loss strips provided in the absorbing sheet structure.

In accordance with still another aspect of the present invention, there is provided an electromagnetic wave absorber for electromagnetic waves comprising a ferrite absorbing layer, a low dielectric layer formed on the ferrite absorbing layer, and a conductive sheet structure provided on the low dielectric layer.

In accordance with still another aspect of the present invention, there is provided an electromagnetic wave absorber for electromagnetic waves comprising a retainer, a plurality of conductive strips arranged in multi-levels more than two levels, in which the conductive strips on at least one level is different in interval from the other conductive strips on the other levels.

In accordance with still another aspect of the present invention, there is provided an electromagnetic wave absorber for electromagnetic waves comprising a high conductivity non-woven fabric sheet members, and a low conductivity non-woven fabric sheet members intervening between the high conductivity non-woven fabric members, respectively, in which through holes are formed in the high conductivity non-woven fabric members.

In accordance with still another aspect of the present invention, there is provided a process of fabricating an electromagnetic wave absorber comprising the steps of forming a plurality of non-woven fabric sheet members each containing conductive fibers of a high molecular compound heat-fusible fibers and insulative fibers of a high molecular compound, overlapping the non-woven fabric sheet members with one another, and applying heat to the non-woven fabric sheet members for fusible bonding.

In accordance with still another aspect of the present invention, there is provided a process of forming a non-woven fabric comprising the steps of preparing conductive fibers formed with high molecular compound fibers coated with a conductive metal and insulative fibers, mixing the conductive fibers with the insulative fibers to produce a mixture, fraying the mixture, and forwarding the mixture to shape into a sheet member.

BRIEF DESCRIPTION OF THE DRAWINGS

The features and advantages of an electronic wave absorber according to the present invention will be more clearly understood from the following description taken in conjunction with the accompanying drawings in which.

DESCRIPTION OF THE PREFERRED EMBODIMENTS

First Embodiment

Figure 1:
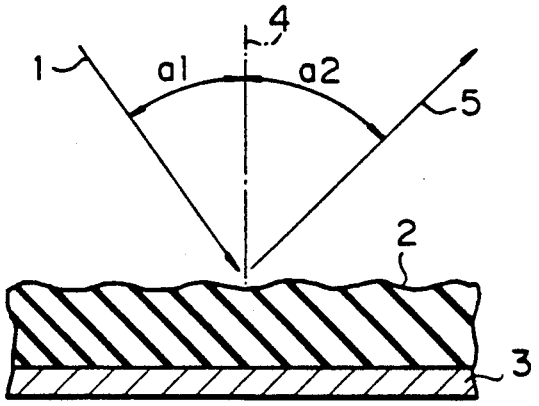
FIG. 1 (PRIOR ART)
FIG. 1 is a cross sectional view showing an electromagnetic wave absorber for a general description of the electromagnetic wave absorbing properties.
Figure 2:
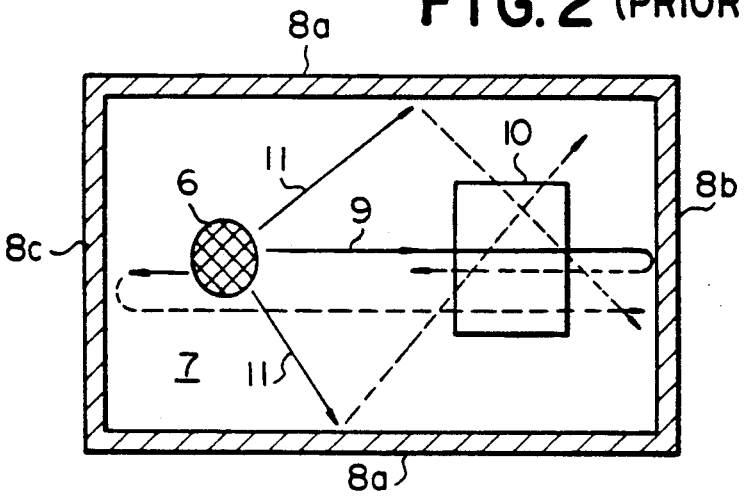
FIG. 2 (PRIOR ART)
FIG. 2 is a plan view showing an electromagnetic wave shielding room defined by side walls formed of electromagnetic wave absorbers.
Figure 3:
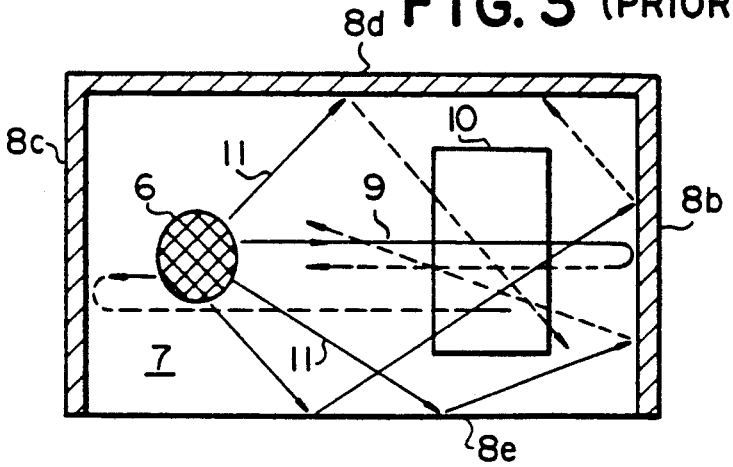
FIG. 3 (PRIOR ART)
FIG. 3 is a side view showing the electromagnetic wave shielding room shown in FIG. 2.
Figure 4:
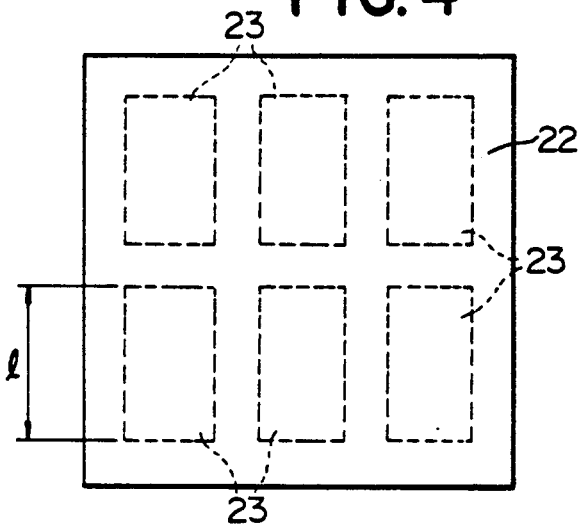
FIG. 4 is a plan view showing the arrangement of an electromagnetic wave absorbing unit embodying the present invention.
Figure 5:
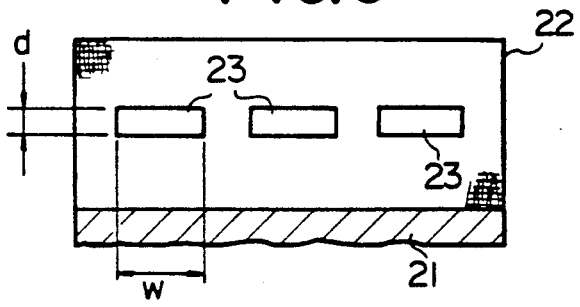
FIG. 5 is a cross sectional view showing the structure of the electromagnetic wave absorbing unit shown in FIG. 4.

Referring first to FIGS. 4 and 5 of the drawings, there is shown an electromagnetic wave absorbing unit embodying the present invention. The electromagnetic wave absorbing unit is provided on a metal plate 21 and comprises a dielectric sheet 22 with a relatively low loss and a plurality of electromagnetic wave absorbing strips 23 with a relatively high loss provided in the dielectric sheet 22 and arranged in matrix. Assuming now that the electromagnetic wave has a wavelength L, each of the electromagnetic wave absorbing strips 23 is selected to have a thickness d less than 10% of the wavelength L. The electromagnetic wave absorbing strip 23 has a width w greater than 10% of the wavelength L but less than ten times the wavelength L. The length 1 of each electromagnetic wave absorbing strip 23 is greater than the width w.

The electromagnetic wave absorbing strips 23 each having the predetermined dimension are thus provided in the dielectric sheet 22, and, for this reason, the electromagnetic wave is not only absorbed but also scattered in a multiple manner by the absorbing strips 23.

Then, the electromagnetic wave with the wavelength L effectively decays. The dielectric sheet 22 with the relatively small loss is operative to support the electromagnetic wave absorbing strips 23 and, further, effectively cause the electromagnetic wave to decay.

Figure 6:
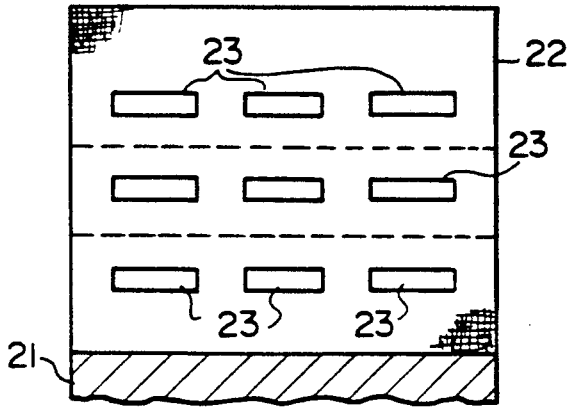
FIG. 6 is a cross sectional view showing the structure of a modification of the electromagnetic wave absorbing unit shown in FIG. 4.

In a modification, the electromagnetic wave absorbing units each shown in FIGS. 4 and 5 are laminated to form a multi-layer structure illustrated in FIG. 6. All of the behaviors described in connection with the single electronic wave absorbing unit are similarly observed in the modification, and a multiple-reflection is achieved between the electromagnetic wave absorbing strips 23 provided in the different levels depending upon the electromagnetic waves absorbed thereby.

It is necessary for achievement of an improved absorbing properties to select the medium constants of the dielectric sheet 22 and each absorbing strips, the thickness of the dielectric sheet 22, the location of each absorbing strip, the dimensions of the absorbing strips and the arrangement of the matrix. Various examples of the first embodiment are described hereinunder.

First Example

Figure 7:
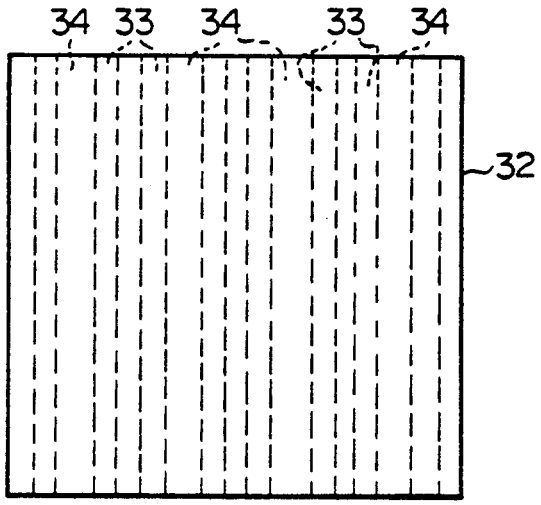
FIG. 7 is a plan view showing the arrangement of a first example of the electromagnetic wave absorbing unit illustrated in FIGS. 4 and 5.
Figure 8:
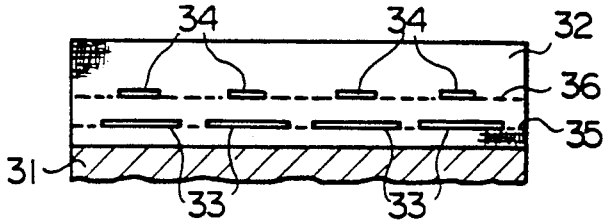
FIG. 8 is a cross sectional view showing the structure of the first example shown in FIG. 7.

The first example aims at the absorption of electromagnetic waves ranging between about 10 GHz and about 15 GHz. The first example of the electromagnetic wave absorbing unit is illustrated in FIGS. 7 and 8 and is fabricated on a metal plate 31. The electromagnetic wave absorbing unit illustrated in FIGS. 7 and 8 comprises a low loss sheet structure 32 with a thickness of about 12.0 millimeters, a plurality of first high loss strips 33 provided in the low loss sheet structure 32 and spaced from one another by a distance of about 3.0 millimeters, and a plurality of second high loss strips 34 also provided in the low loss sheet structure and spaced from one another in an overlapping manner with respect to respective central portions of the first high loss strips 33, respectively. The first high loss strips 33 are provided on a virtual plane 35 with a height of about 3.0 millimeters measured from the metal plate 31, and the second high loss strips 34 are arranged on a virtual plane 36 with a height of about 6.0 millimeters from the metal plate 31.

Each of the first high loss strips 33 is about 0.8 millimeter in thickness and about 40 millimeters in width, the length of each first high loss strip 33 is equal to that of the low loss sheet 32. On the other hand, the thickness d and the width w are selected to be about 0.8 millimeter and about 20 millimeters, respectively, for each of the second high loss strips 34, and each second high loss sheet 34 is as long as the first high loss strips 33 as will be seen from FIG. 7.

The low loss sheet structure 32 is formed by a plurality of non-woven fabric sheet with conductive fibers interlaced with insulative fibers The conductive fibers are about 2.0% by weight with respect to the non-woven fabric sheet. The non-woven fabric sheet is about 3.0 millimeters in thickness, and the low loss sheet structure 32 is, accordingly, adjusted by stacking a predetermined number of the non-woven fabric sheets. Each of the first and second high loss strips 33 and 34 is also formed by the non-woven fabric similar to that used for formation of the low loss sheet structure 32. However, the non-woven fabric for the high loss strips is shaped into a sheet different in thickness from that used for the low loss sheet structure 32. In this example, the non-woven fabric sheet for the high loss strips is selected to be about 0.8 millimeter in thickness. The low loss sheet structure 32 and the high loss strips 33 and 34 are implemented by the non-woven fabric in this example, however, any material is available in so far as the loss and the thickness thereof are adjustable.

Figure 9:
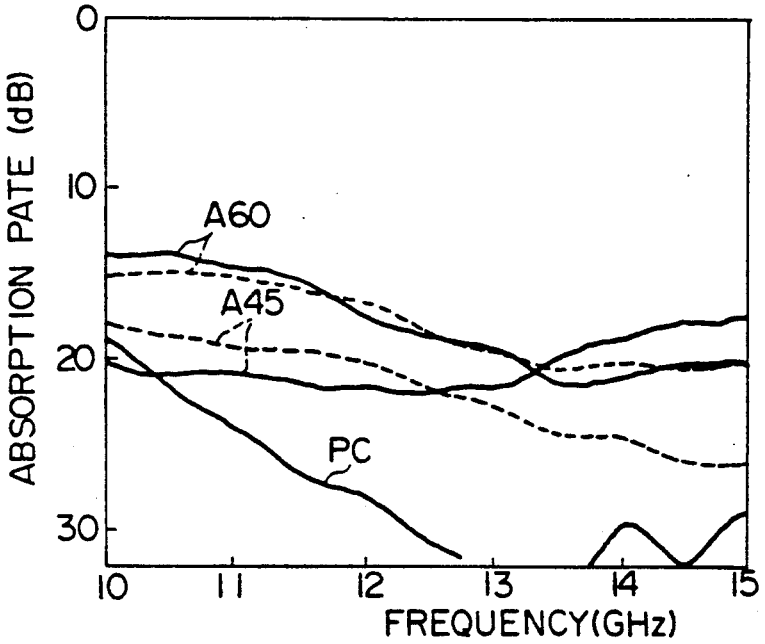
FIG. 9 is a graph showing the absorption rate in terms of the frequency achieved by the first embodiment.
Figure 10:
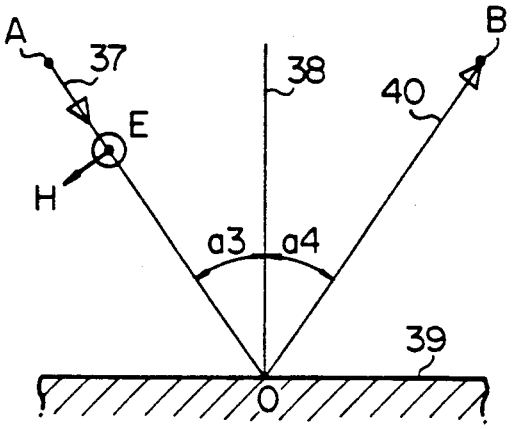
FIG. 10 is a view for describing the transverse electric polarized plane wave ( which is abbreviated as "TE" wave)
Figure 11:
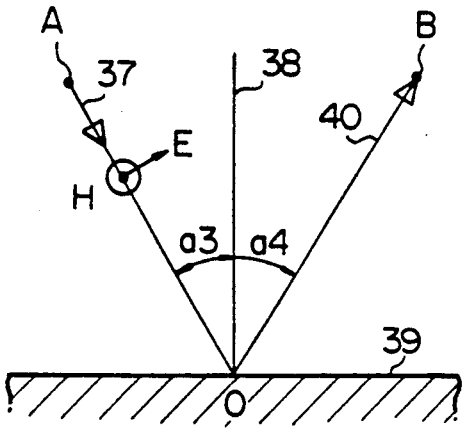
FIG. 11 is a view for describing the transverse magnetic polarized wave ( which is abbreviated as "TM" wave )

The absorbing properties are measured for the first example. FIG. 9 is a graph showing the absorption rate in terms of the frequency. The absorption rate is measured for a transverse electric polarized plane wave as well as a transverse magnetic polarized wave. Plots PC are indicative of the transverse electric polarized plane wave, i. e., radiation at the incident angle zero. Plots A60 stand for both of the transverse electric polarized plane ( represented by the real line ) and the transverse magnetic polarized wave ( represented by the dash lines ) at the incident angle of about 60 degrees. On the other hand, plots A45 are representative of both of the transverse electric polarized plane ( represented by the real line ) and the transverse magnetic polarized waves ( represented by the dash lines ) at the incident angle of about 45 degrees. The transverse electric polarized plane wave and the transverse magnetic polarized wave are defined as follows. FIGS. 10 and 11 show the definitions of the transverse electric polarized plane and transverse magnetic polarized waves, respectively. Assuming now that an electromagnetic wave 37 is radiated from point A at angle of about a3 with respect to the perpendicular plane 38, the electromagnetic wave 37 is reflected from point 0 on the electromagnetic wave absorber 39 to produce the reflection 40 at angle a4 with respect to the perpendicular plane 38. The reflection 40 proceeds to point B as shown in FIG. 10. The transverse electric polarized plane wave is defined as a wave having an electric field vertical with respect to the plane defined by the points A, 0 and B. On the other hand, the transverse magnetic polarized wave is defined as a wave having an electric field parallel to the plane defined by the points A, 0 and B as shown in FIG. 11.

As will be understood from FIG. 9, the absorption rate equal to or greater than about 20 dB is achieved for the perpendicular incident angle, and the absorption rate over about 15 dB is achieved until the oblique incident angle reaches about 60 degrees.

Second Example

Figure 12:
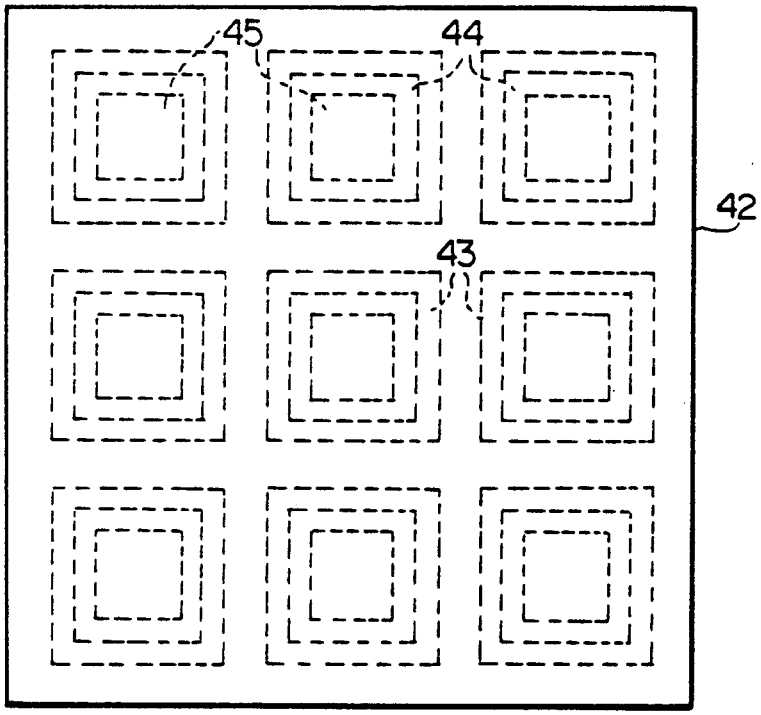
FIG. 12 is a plan view showing the arrangement of a second example of the first embodiment illustrated in FIGS. 4 and 5.
Figure 13:
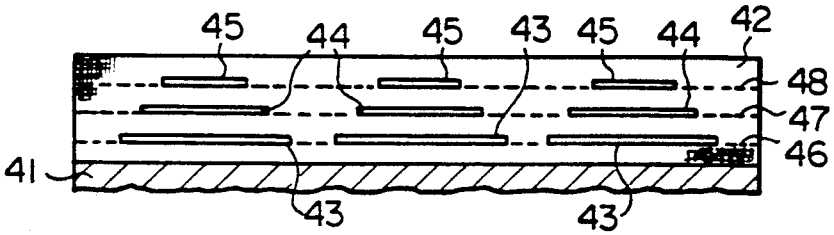
FIG. 13 is a cross sectional view showing the structure of the second example of the first embodiment.

Turning to FIGS. 12 and 13 of the drawings, there is shown a second example of the first embodiment illustrated in FIGS. 4 and 5. The second example also aims at the absorption of electromagnetic waves ranging between about 10 GHz and about 15 GHz. The electromagnetic wave absorbing unit illustrated in FIGS. 12 and 13 is fabricated on a metal plate 41 and comprises a low loss sheet structure 42 with a thickness of about 12.0 millimeters, a plurality of first high loss strips 43 provided in the low loss sheet structure 42 and arranged in matrix, a plurality of second high loss strips 44 also provided in the low loss sheet structure 42 and spaced from one another in an overlapping manner with respect to respective central portions of the first high loss strips 43, respectively, and a plurality of third high loss strips 45 provided in the low loss sheet structure 42 and arranged in an overlapping manner with respect to respective central portions of the second high loss strips 44, respectively. The first high loss strips 43 are provided on a virtual plane 46 with a height of about 3.0 millimeters measured from the metal plate 41, and the second high loss strips 34 are arranged on a virtual plane 47 with a height of about 6.0 millimeters from the metal plate 41. The third high loss strips 45 are arranged on a virtual plane 48 spaced apart from the metal plate 41 by about 9.0 millimeters, and, as a result, the high loss strips 46 to 48 are formed as a three-level structure.

Each of the first high loss strips 43 is about 0.8 millimeter in thickness, about 40 millimeters in width and about 40 millimeters in length, and the thickness d, the width w and the length 1 are selected to be about 0.8 millimeter, about 30 millimeters and about 30 millimeters, respectively, for each of the second high loss strips 44. Each of the third high loss strips 45 have a thickness of about 0.8 millimeter, and the width and the length thereof are about 20 millimeters.

The non-woven fabric similar to the first example is used for forming the low loss sheet structure 42 and the high loss strips 43 to 45.

Figure 14:
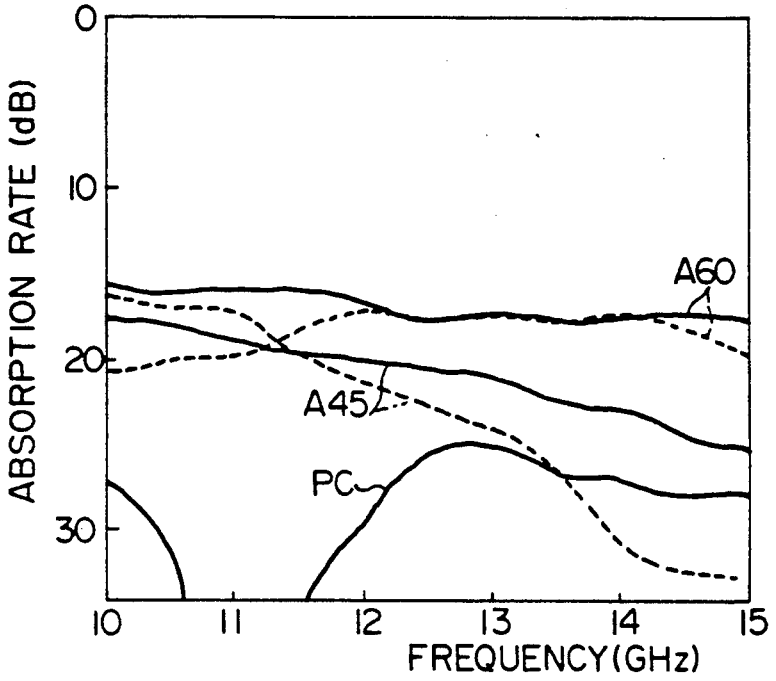
FIG. 14 is a graph showing the absorption rate in terms of the frequency measured for the second example shown in FIG. 13.

The second example is evaluated in view of the absorption rate as similar to the first example. FIG. 14 shows the absorption rate in terms of the frequency. The plots PC, A60 and A45 stand for the waves similar to those of FIG. 9. According to FIG. 14, the absorption rate equal to or greater than about 25 dB is achieved for the perpendicular incident angle, and the absorption rate over about 15 dB is achieved until the oblique incident angle reaches about 60 degrees.

Thus, the first embodiment of the present invention is extremely reduced in thickness without sacrifice of the oblique incident properties.

Second Embodiment

Figure 15:
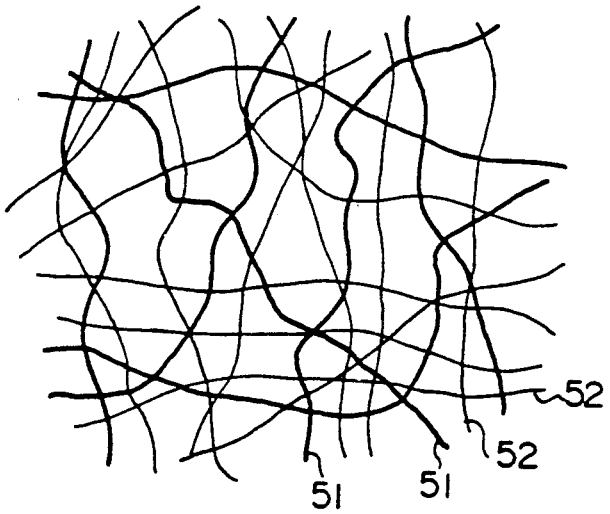
FIG. 15 is a view showing, an enlarged scale, the structure of a non-woven fabric used in a second embodiment of the present invention.

Turning to FIG. 15 of the drawings, there is shown the structure of a non-woven fabric used in the second embodiment of the present invention. The non-woven fabric shown in FIG. 15 is electrically insulative, however, has conductive fibers 51 interlaced with insulative fibers 52. Each of the conductive fibers 51. Each of the conductive fibers 51 is formed with a stainless steel or a resin fiber coated with a conductive metal such as, for example, copper or nickel, and each of the insulative fibers is, on the other hand, formed of a resin fiber without any conductive metal. The conductive fibers are fallen within a range between about 0.5% and about 10% by weight with respect to the non-woven fabric. A current is induced in the conductive fibers 51 due to the radiation of the electromagnetic waves, and, for this reason, the conductive fibers 51 cause the electromagnetic waves to decay.

Figure 16:
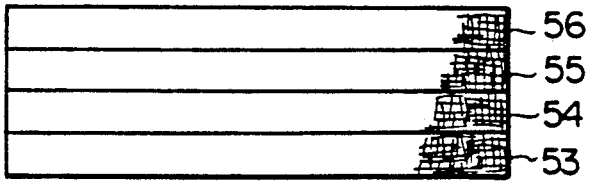
FIG. 16 is a cross sectional view showing the structure of the second embodiment of the present invention.

Turning to FIG. 16 of the drawings, there is shown the structure of an electromagnetic wave absorber fabricated by using the non-woven fabric illustrated in FIG. 15. The electromagnetic wave absorber is formed in a four-layer structure which is provided with first, second, third and fourth non-woven fabric sheets 53, 54, 55 and 56. Each of the fabric sheets 53 to 56 is about 3 millimeters in thickness, then the absorber has a thickness around 15 millimeters. All of the non-woven fabric sheets 53 to 56 are shaped with the conductive fibers 51 and the insulative fibers 52 interlaced with one another, however, are different in mixing rate from one another. Namely, the first non-woven fabric sheet 53 contains the conductive fibers 51 which is about 5% by weight with respect to the non-woven fabric, however, the conductive fibers 51 are interlaced with the insulative fibers 51 at about 3% by weight in the second non-woven fabric sheet 54. The third non-woven fabric sheet 55 contains the conductive fibers 51 which are about 1.5% by weight with respect to the non-woven fabric, however, the conductive fibers 51 are mixed with the insulative fibers 51 at about 1% by weight in the fourth non-woven fabric sheet 56. In this instance, each of the conductive fibers 51 is formed with a resin fiber of polyacylic-nitry coated with nickel, and polyethylene resin is used for formation of the insulative fibers 52. However, no limitation is set to the material used for both of the conductive fibers 51 and the insulative fibers 52.

The absorption of the electromagnetic wave is in proportional to the density of the conductive fibers 51. Then, the electromagnetic wave absorber illustrated in FIG. 16 is increased in density of the conductive fibers from fourth non-woven fabric sheet 56 to the first non-woven fabric sheet 53.

Figure 17:
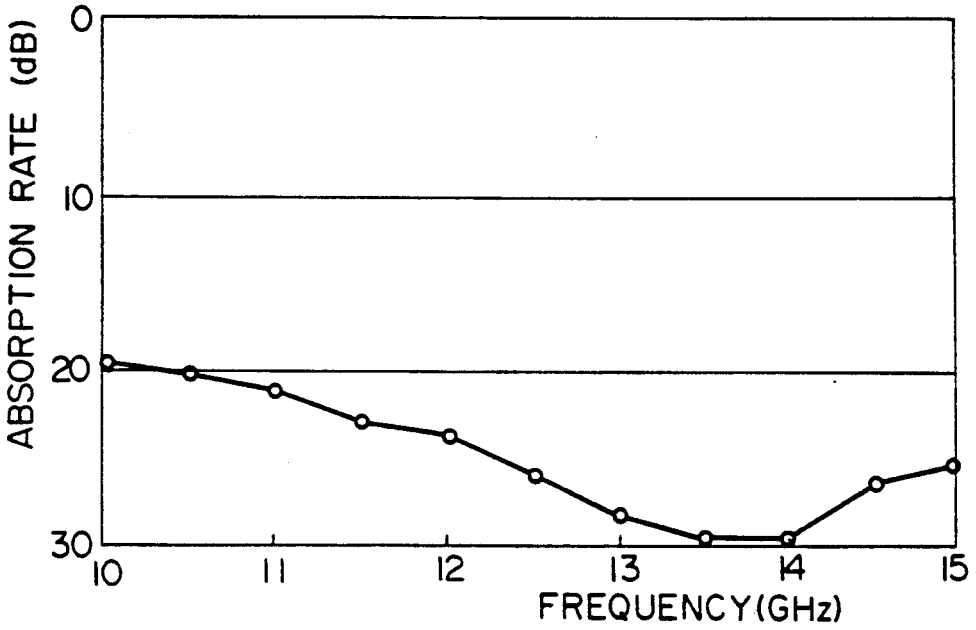
FIG. 17 is a graph showing the absorbing rate achieved by the second embodiment of the present invention in terms of the frequency of the electromagnetic wave perpendicularly radiated.
Figure 18:
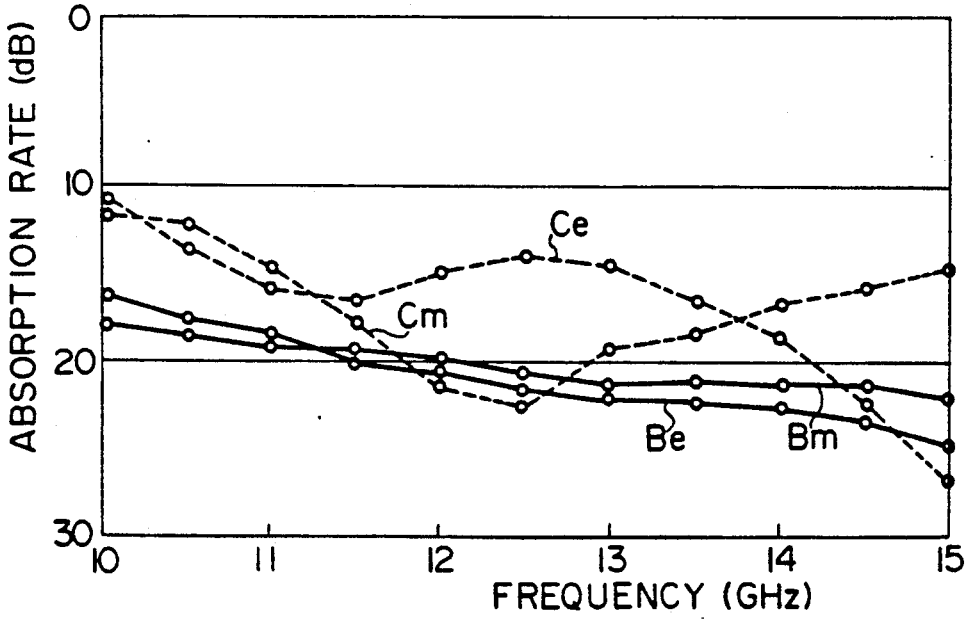
FIG. 18 is a graph showing the absorbing rate of the second embodiment of the present invention in terms of the frequency of the electromagnetic wave radiated at about 45 degrees.

The electromagnetic wave absorber shown in FIG. 16 is evaluated in view of the absorbing properties. FIG. 17 shows the absorption rate in terms of the frequency of the electromagnetic wave radiated to the electromagnetic wave absorber shown in FIG. 16. The electromagnetic waves are perpendicularly radiated onto the fourth non-woven fabric sheet 56. As will be understood from FIG. 17, the electromagnetic waves absorber shows inferior absorbing properties for the electromagnetic waves ranging between about 10 GHz and about 15GHz. The oblique incident properties are also examined as shown in FIG. 18. Real lines in FIG. 18 stand for the electromagnetic wave absorber shown in FIG. 16 to which electromagnetic waves are radiated at incident angle 45 degrees with respect to the perpendicular place, and dash lines stand for the prior-art electromagnetic wave absorber of the two-layer structure of a rubber type disclosed in Japanese Patent Application No. 56-109686. Similarly, Hatakeyama et al. disclose an absorbing material dispersed with short metal fibers in IEEE TRANSACTIONS ON MAGNETICS, vol. Mag. 20, No. 5, September 1984, and the absorbing material is provided with a two-layer construction and responsible in GHz frequency range. According to the abstract in the paper, each layer operates as a low impedance resonator and an impedance transformer. For the low-impedance resonator design, a ferrite/resin mixture incorporated with short metal fibers is used. The electromagnetic wave absorber disclosed in that paper has a broader operation bandwidth, nearly 50% in relative bandwidth ( bandwidth more than 20 dB absorbtion/center frequency ), than the operation bandwidth for a conventional ferrite absorber. Broadband characteristics are achieved in oblique incidence, up to nearly 45 degrees of incident angle. Electromagnetic waves are also radiated to the prior-art absorber at the oblique incident angle of about 45 degrees with respect to the perpendicular plane. The real lines Bm and Be are respectively indicative of the absorbing properties in terms of the transverse magnetic polarized wave ( or TM wave ) and of the absorbing properties in terms of the transverse electric polarized plane wave ( or TM wave ). Similarly, the dash lines Cm and Ce are respectively indicative of the absorbing properties in terms of the transverse magnetic polarized wave and of the absorbing properties in terms of the transverse electric polarized plane wave. Comparing the real lines Bm and Be with the dash lines Cm and Ce, it is understood that the electromagnetic wave absorber of the second embodiment is advantageous over the prior-art absorber in the oblique incident properties.

The second embodiment is advantageous in lightness over the prior-art rubber type absorber. In fact, the electromagnetic wave absorber illustrated in FIG. 16 is 470 grams per square meter, however, the prior-art rubber type absorber is as heavy as 8 kilograms per square meter.

Figure 19:
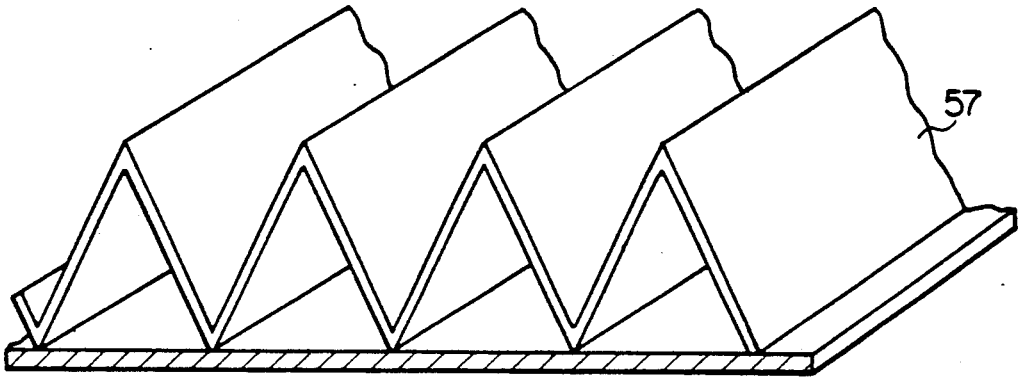
FIG. 19 is a perspective view showing the structure of a modification of the second embodiment.
Figure 20:
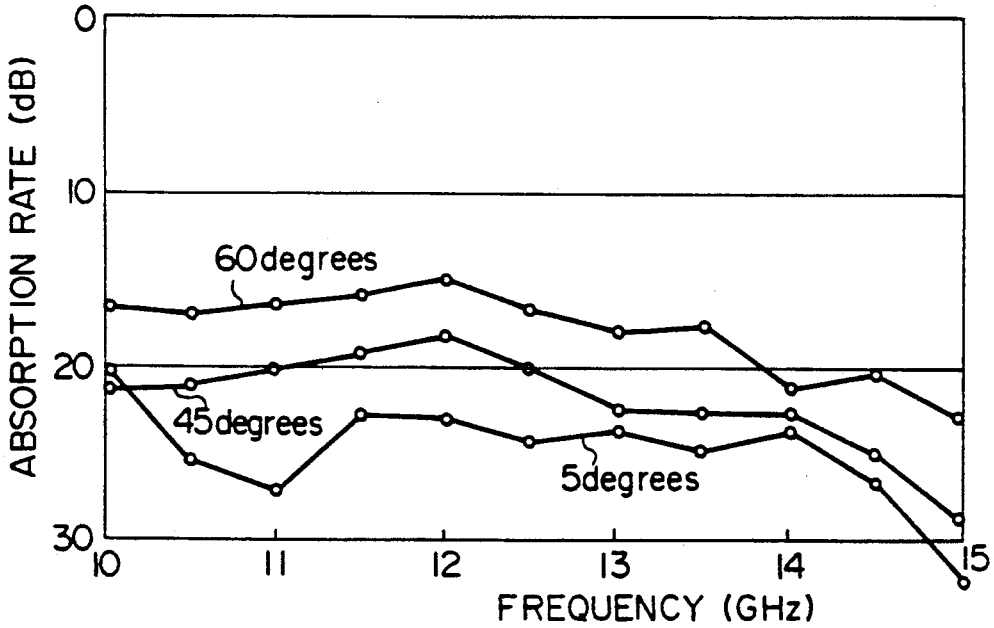
FIG. 20 is a graph showing the oblique incident absorbing properties achieved by the modification shown in FIG. 19.

Turning to FIG. 19 of the drawings, there is shown a modification of the second embodiment which is shaped into a wave-like configuration. The wave-like sheet member 57 is formed of the non-woven fabric illustrated in FIG. 15 and is generally triangle in cross section. The electromagnetic wave absorber illustrated in FIG. 19 aims at the absorption of electromagnetic waves ranging between about 10 GHz and about 15 GHz. Referring to FIG. 19, for example, the wave like portion has a height (h) of about 35 mm, the component plates have a thickness (t) of about 3 mm, and the peak to peak distance (d) between the adjacent wave-like portions is about 24 mm. FIG. 20 shows the oblique incident properties at about 5 degrees, about 45 degrees and about 60 degrees, respectively. By virtue of the wave-like configuration, the electromagnetic wave absorber shown in FIG. 19 is inferior in various oblique incident angles.

Third Embodiment

Figure 21:
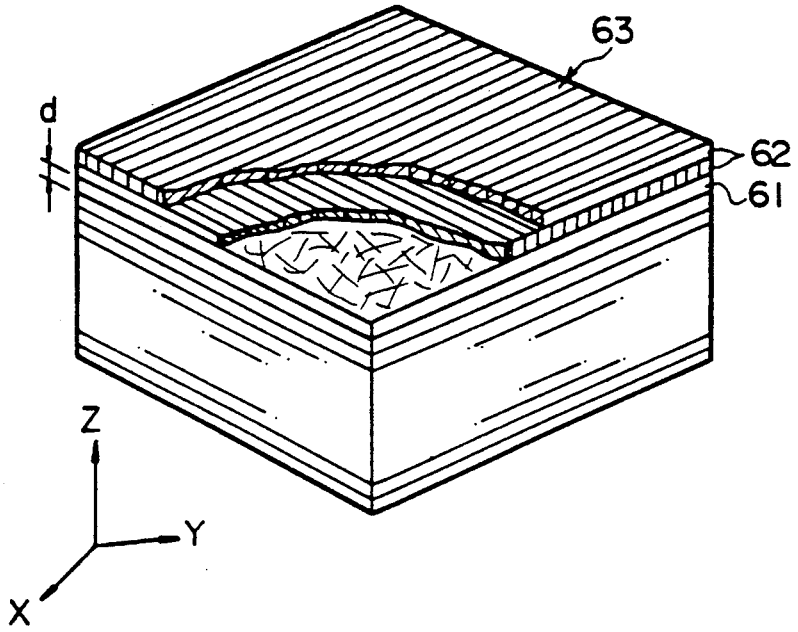
FIG. 21 is a perspective view showing the structure of a third embodiment according to the present invention.
Figure 22:
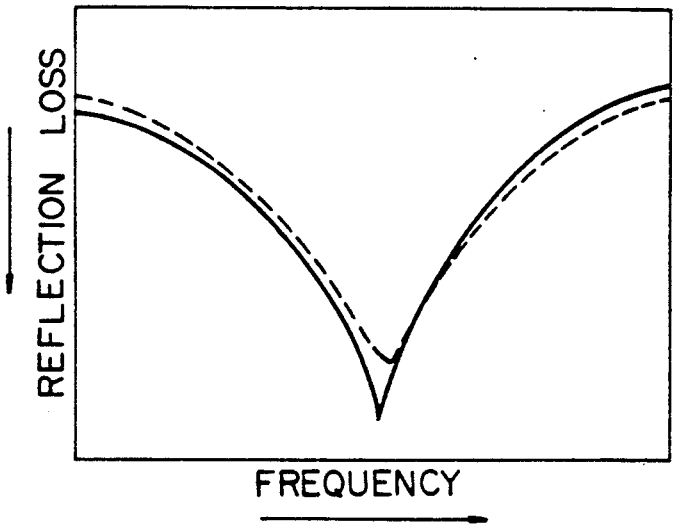
FIG. 22 is a graph showing the reflection loss in terms of the frequency of the electromagnetic wave measured for the third embodiment.
Figure 23:
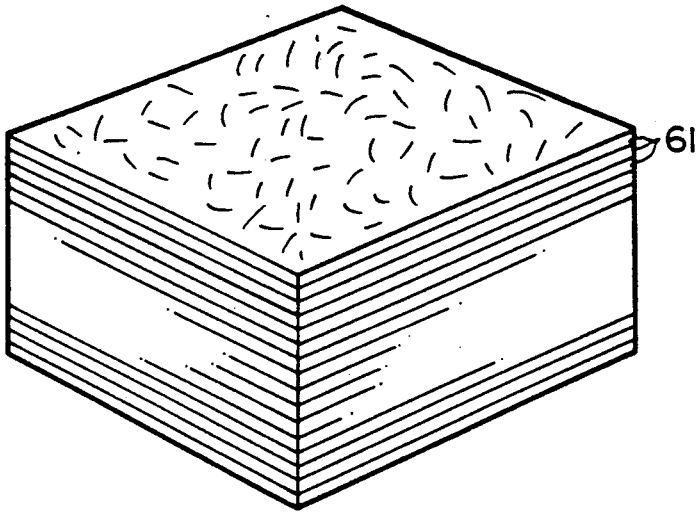
FIG. 23 is a perspective view showing an electromagnetic wave absorber fabricated for a comparison use.
Figure 24:
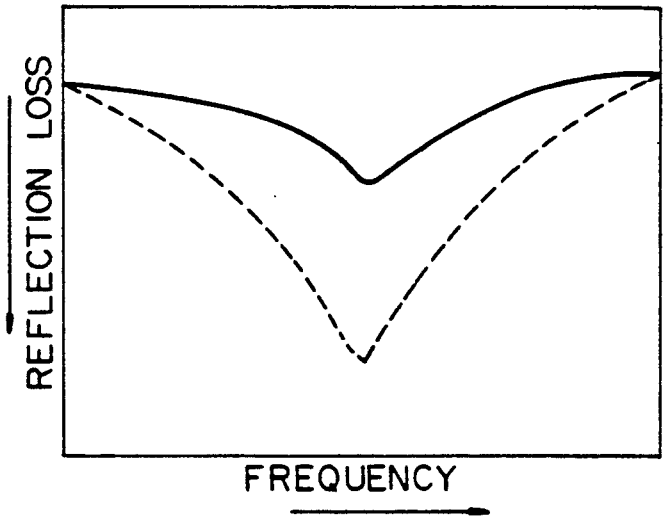
FIG. 24 is a graph showing the reflection loss in terms of the frequency of the electromagnetic wave measured for the electromagnetic wave absorber illustrated in FIG. 23.

Turning to FIG. 21 of the drawings, the structure of another electromagnetic wave absorber is illustrated and has a multi-layer structure provided with a plurality of first absorbing sheet members 61 and a plurality of second absorbing sheet structures 62. The first absorbing sheet members 61 are alternatively overlapped with the second absorbing sheet structures 62, and the first absorbing sheet members 61 and second absorbing sheet structures 62 are respectively characterized by the dominative orientation of fibers. Namely, assuming now that the electromagnetic wave absorber is placed in such a manner that the electromagnetic wave absorber has the rectangular top surface 63 defined by X and Y axes and a thickness in parallel to Z axis, each of the first absorbing sheet members is formed with conductive fibers and insulative fibers interlaced with one another, and most of the conductive fibers and the insulative fibers are oriented in parallel to a plane defined by the X and Y axes. On the other hand, each of the second absorbing sheet structures 62 is formed with the conductive fibers and the insulative fibers most of which are oriented in parallel to the Z axis. Each first absorbing sheet member 61 and each second absorbing sheet structure 62 are smaller in thickness than wavelengths of electromagnetic waves radiated on the top surface 63. Each of the conductive fibers is formed with a resin fiber coated with a conductive metal, and each insulative fiber is formed of an insulative resin. By virtue of such a structure, the conductive fibers are equivalent to being oriented in all directions, and, for this reason, the absorbing properties, especially, the oblique incident absorbing properties are improved independently from the polarized waves. FIG. 22 shows the reflection loss in terms of the frequency of the electromagnetic wave measured for the third embodiment. In FIG. 22, the real line is indicative of the transverse magnetic polarized wave, and the dash lines stand for the transverse electric polarized plane wave. For comparison use, an electromagnetic wave absorber provided with the first absorbing sheet members only is fabricated as shown in FIG. 23. The reflection loss is also measured for the transverse magnetic polarized wave ( represented by the real line ) and the transverse electric polarized plane wave ( represented by the dash lines ) as shown in FIG. 24. As will be understood from FIGS. 22 and 24, the electromagnetic wave absorber illustrated in FIG. 21 effectively absorbs the oblique incident electromagnetic waves of various frequencies independent from the polarized waves. This is because of the fact that the transverse electric polarized plane wave is absorbed by the conductive fibers oriented in parallel to the plane defined by the axes X and Y, however, the transverse magnetic polarized plane wave is absorbed by the conductive fibers oriented in parallel to the axis Z.

Figure 25:
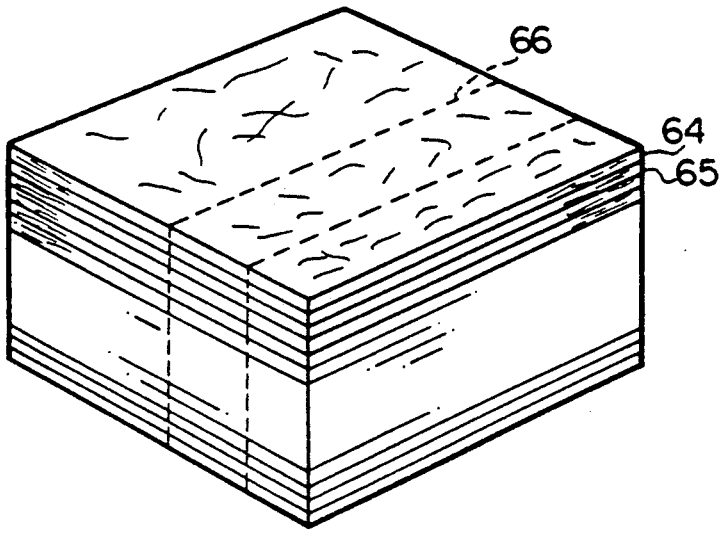
FIG. 25 is a perspective view showing a first stage of the formation process for the second absorbing sheet structure used in the third embodiment.
Figure 26:
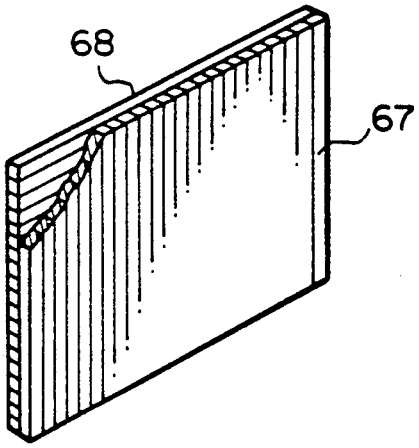
FIG. 26 is a partially cut-away perspective view showing the dominative orientations of the second absorbing sheet members used in the second absorbing sheet structure.

The formation of the second absorbing sheet structure 62 is described as follows with reference to FIGS. 25 and 26. First, the absorbing sheet members 64, 65, . . . each identical with the first absorbing sheet member are overlapped with one another as shown in FIG. 25. The overlapped absorbing sheet members 64, 65 and so on are cut away along vertical planes in parallel to the vertical plane 66 for producing a plurality of second absorbing sheet members 67 and 68, and the second absorbing sheet members 67 and 68 are overlapped with one another in such a manner that the adjacent second absorbing sheet members 67 and 68 are different in the dominative orientation from each other as shown in FIG. 26.

Fourth Embodiment

Figure 27:
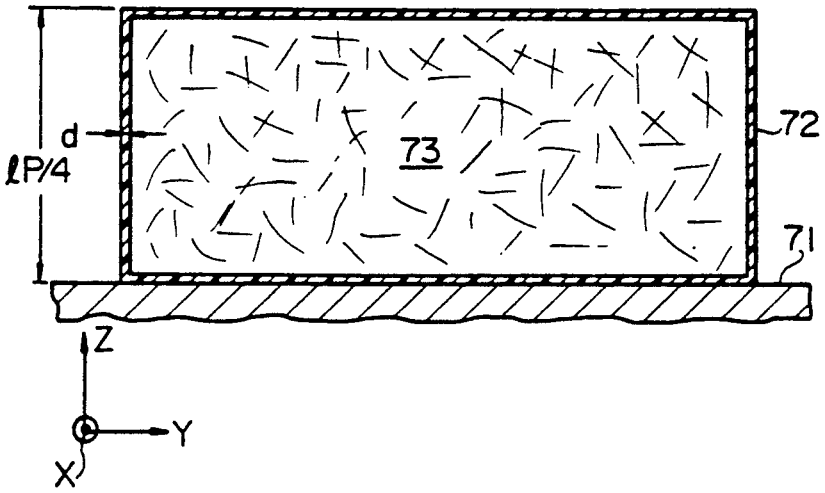
FIG. 27 is a cross sectional view showing the fourth embodiment of the present invention.

Turning to FIG. 27 of the drawings, there is shown a fourth embodiment of the present invention. The electromagnetic wave absorber shown in FIG. 27 is stacked on a metal plate 71 and comprises a box member 72 filled with a mixture 73 of conductive fibers and insulative fibers. The box member 72 is formed of a resin such as, for example, acrylic resin, ABS resin, or a polyester resin, and each of the conductive fibers is formed with a resin fiber coated with a conductive metal, but each of the insulative fibers is formed with a resin fiber without any conductive metal. The conductive fibers thus formed are randomly mixed with the insulative fibers to produce the mixture 73 or a cottony non-woven fabric, and, for this reason, no dominative orientation takes place in the conductive fabrics of the cottony non-woven fabric or the mixture 73. In other words, the conductive fibers are oriented in all directions, and, for this reason, the absorption properties are independent from the polarized waves.

Figure 28:
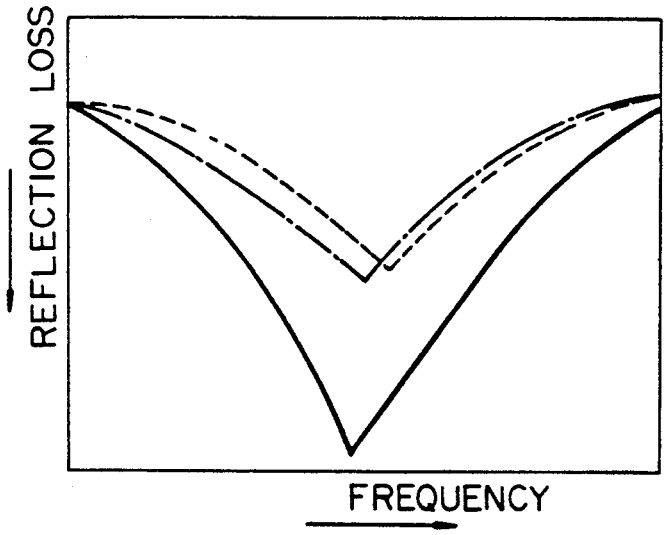
FIG. 28 is a graph showing the reflection loss in terms of the frequency of the electromagnetic wave measured for the fourth embodiment.

As to the dimension of the box member 72, the thickness d is extremely small in value than the wavelengths of electromagnetic waves radiated thereto, and, for this reason, the box member 72 is transparent to the electromagnetic waves. In other words, any reflection hardly takes place at the surface of the box member 72, and any multiple-reflection is hardly produced between the outer surface and the inner surface of the box member 72. The box member 72 is as high as a quarter of a typical wavelength $l_p$ of the electromagnetic waves which the mixture 73 propagates. FIG. 28 shows the reflection loss of the perpendicular incident electromagnetic wave in terms of the frequency which is represented by the real line ) and the reflection losses of the oblique incident electromagnetic waves are also shown for the transverse magnetic polarized plane wave and the transverse electric polarized wave ( which are respectively represented by the dot-and-dash line and dash lines ). As will be understood from comparing the dot-and-dash line with the dash lines, the oblique incident absorbing properties are independent from the polarized waves. Moreover, all absorbing properties are improved with respect to those shown in FIG. 24.

The electromagnetic wave absorber illustrated in FIG. 27 is operative to absorb the electromagnetic waves on the basis of resonant phenomena between the metal plate 71 and the surface of the absorber, and, for this reason, the responsible bandwidth range is not so broad. For this reason, various modifications are proposed for improvement in responsible bandwidth.

First Modification

Figure 29:
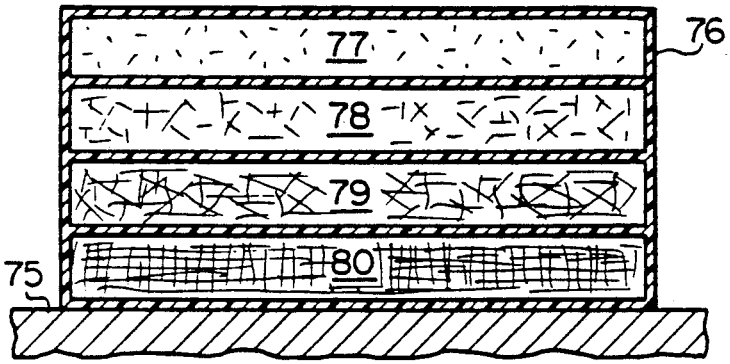
FIG. 29 is a cross sectional view showing a first modification of the fourth embodiment.

FIG. 29 shows the first modification of the fourth embodiment which is stacked on a metal plate 75 and has a multi-layer structure provided with a multi-stage box member 76 having a plurality of hollow spaces filled with mixtures 77, 78, 79 and 80, respectively. All of the mixtures 77 to 80 are similar in component to the mixture 73, i. e., containing the conductive fibers and the insulative fibers formed in the cottony non-woven fabrics, however, are different in density of the conductive fabrics. Namely, the mixtures or the cottony non-woven fabrics 80, 79, 78 and 77 are decreased in the conductive fiber density by spacing from the metal plate 75. This electromagnetic wave absorber is operative to absorb the electromagnetic waves fallen in the broader range than that of the electromagnetic wave absorber illustrated in FIG. 27.

Second Modification

Figure 30:
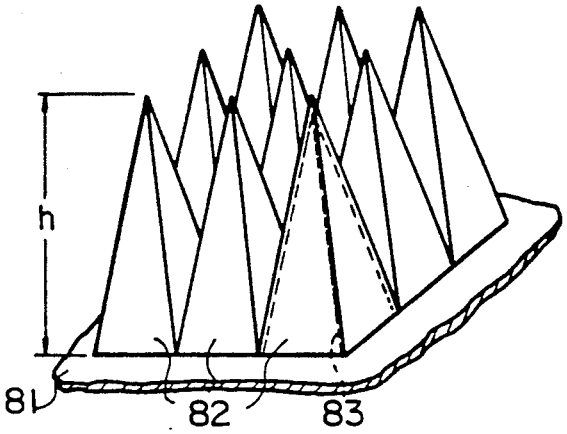
FIG. 30 is a perspective view showing a second modification of the fourth embodiment.

Turning to FIG. 30 of the drawings, there is shown a second modification of the fourth embodiment. The second modification aims at the absorption of the electromagnetic waves in a broader range. The electromagnetic wave absorber illustrated in FIG. 30 is fabricated on a metal plate 81 and comprises a plurality of pyramid-shape members 82 each having a hollow space therein, and mixtures 83 or cottony non-woven fabrics filling the hollow spaces formed in the pyramid-shape members, respectively. Each of the pyramid-shape members 82 has a height h, and the absorption properties are improved for the low frequency electromagnetic waves if the height h is increased in value.

Third Modification

Figure 31:
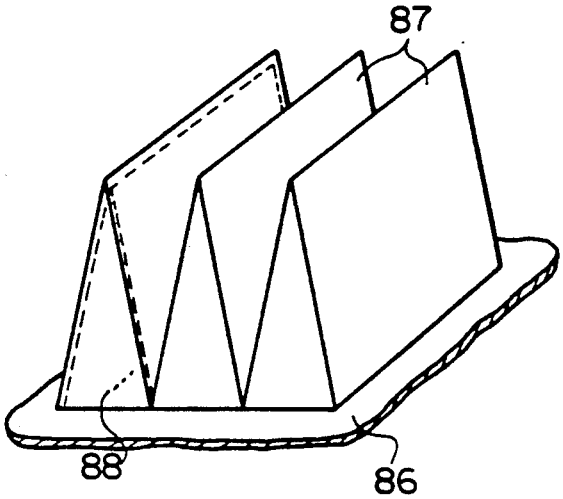
FIG. 31 is a perspective view showing a third modification of the fourth embodiment.
Figure 32:
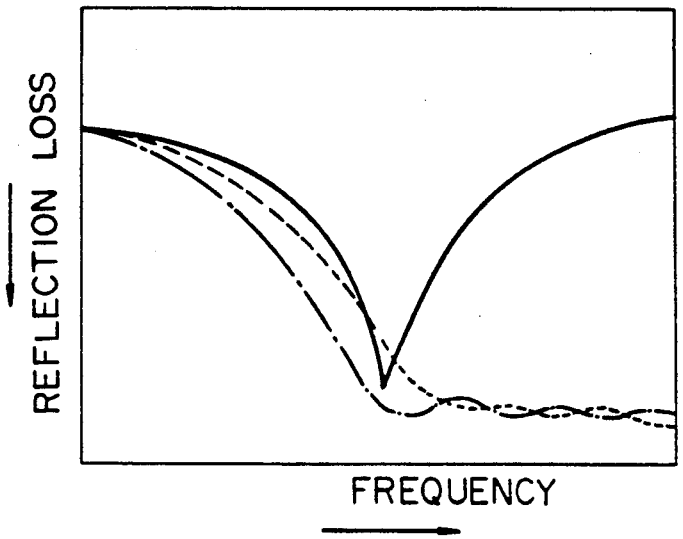
FIG. 32 is a graph showing the reflection loss in terms of the frequency of the electromagnetic wave measured for the third modification of the fourth embodiment.

Turning to FIG. 31 of the drawings, there is shown a third modification of the fourth embodiment. The third modification also aims at the absorption of the electromagnetic waves in a broader range. The electromagnetic wave absorber illustrated in FIG. 31 is fabricated on a metal plate 86 and comprises a plurality of wedge-shape members 87 each having a hollow space therein, and mixtures 88 or cottony non-woven fabrics filling the hollow spaces formed in the wedge-shape members, respectively. The absorption properties are improved for the low frequency electromagnetic waves if the wedge members are increased in height. The absorbing properties of the third example are shown in FIG. 32 in which the real line is indicative of the reflection loss in terms of the frequency of the perpendicular incident electromagnetic waves, and the dot-and-dash line and the dash lines stands for the oblique incident electromagnetic waves radiated to the absorber illustrated in FIG. 29 and the oblique incident electromagnetic wave radiated to the absorber illustrated in FIG. 31, respectively. Comparing the dot-and-dash line with the dash lines, it is understood that the wedge type electromagnetic wave absorber is improved in responsible bandwidth.

Fifth Embodiment

Figure 33:
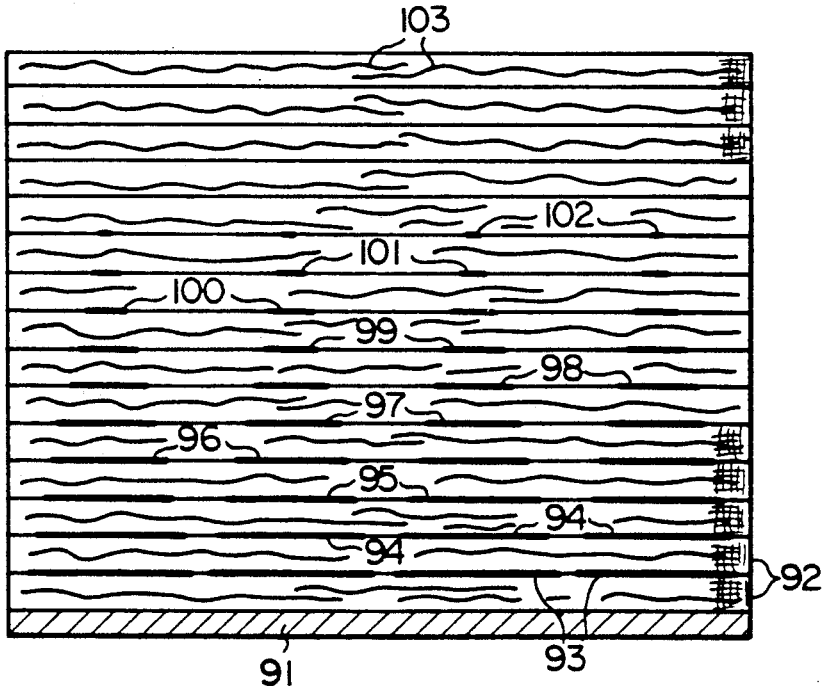
FIG. 33 is a cross sectional view showing the structure of a fifth embodiment according to the present invention.

Turning to FIG. 33 of the drawings, there is shown a fifth embodiment according to the present invention. The fourth embodiment aims at the absorption of electromagnetic waves greater than about 300 MHz. The electromagnetic wave absorber illustrated in FIG. 33 is fabricated on a metal plate 91 and comprises a plurality of absorbing sheet members 92 overlapped with one another, and high loss strips 93, 94, 95, 96, 97, 98, 99, 100, 101 and 102 sandwiched at boundaries between the first to eleventh absorbing sheet members 92. The combination of the absorbing sheet member 92 and the high loss strips as a whole form a scattering-type absorbing unit.

In this instance, the absorbing sheet member 92 is formed of a non-woven fabric provided with conductive fibers 103 interlaced with insulative fibers, and most of the conductive fibers are as long as about 250 millimeters, and the conductive fibers are about 1% by weight with respect to the non-woven fabric. The non-woven fabric is shaped into about 20 millimeters thick to provide the absorbing sheet members 92. Each of the high loss strips 93 to 102 is formed of a non-woven fabric which is formed by mixing conductive fibers with about 40 millimeters into insulative fibers at a ratio of about 10% by weight with respect to the non-woven fabric. All of the high loss strips 93 to 102 are about 2 millimeters in thickness and varied in width from about 100 millimeters to about 10 millimeters. Namely, each of the high loss strips 93 is about 100 millimeters in width, but each high loss strip 102 is about 10 millimeters in width.

Figure 34:
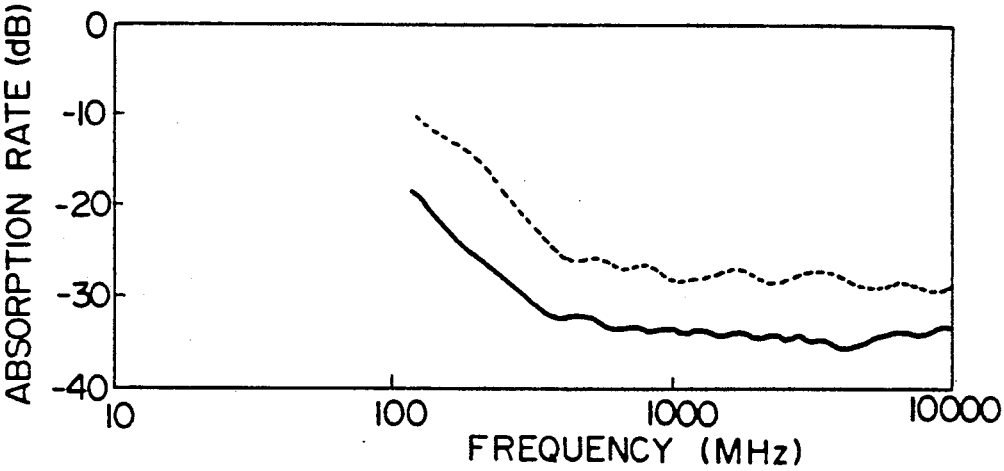
FIG. 34 a graph showing the absorption rate in terms of the frequency of the incident electromagnetic wave measured for the fifth embodiment.
Figure 35:
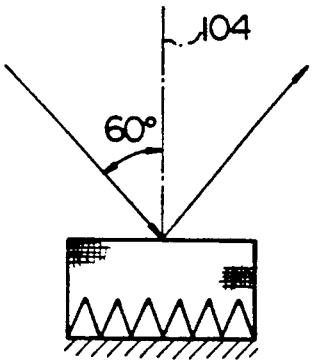
FIG. 35 is a view for description for the incident angle of the electromagnetic wave radiated to the fifth embodiment.

It is possible to form a non-uniform scattering medium by using the non-woven fabric which is formed by mixing the conductive fibers having a length greater than a quarter of a dominative wavelength of the electromagnetic waves with the insulative fibers. The mixing ratio of the conductive fibers is appropriately selected. The reflection of the electromagnetic waves are reduced in comparison with the reflection produced in a uniform medium by virtue of the scattering phenomena. Although it is possible for the absorber formed by the non-woven fabric only to absorb the electromagnetic waves in GHz range. The wavelength is decreased in the non-woven fabric with respect to that in a free space, and, for this reason, the scattering effects are enhanced in the medium formed with the non-woven fabric containing the scattering type absorbing strips in comparison with the strips in the free space. This results in that the absorbing strips can be decreased in size when being provided in the non-woven fabric. Then, it is possible to fabricate a thin electromagnetic wave absorber even if the non-woven fabrics are laminated. In fact, the electromagnetic wave absorber is improved in the absorbing properties. FIG. 34 shows the absorption rate measured for the perpendicular incident electromagnetic waves and the oblique incident electromagnetic waves radiated thereto at about 60 degrees with respect to the perpendicular plane 104 as shown in FIG. 35. As will be seen from FIG. 34, the absorption rate greater than about 30 dB is achieved for the perpendicular incident electromagnetic waves larger in frequency than 300 MHz as indicated by the real line, and the absorption rate greater than about 20 dB is achieved for the oblique incident electromagnetic waves at about 60 degrees.

In this instance, the non-woven fabric containing a large amount of the conductive fibers is used for the internal absorbing sheet members, however, any material is available in so far as it provides a high loss. Moreover, the absorber may be filled with the high loss strips. No limitation is set to the configuration of the electromagnetic wave absorber.

Sixth Embodiment

Figure 36:
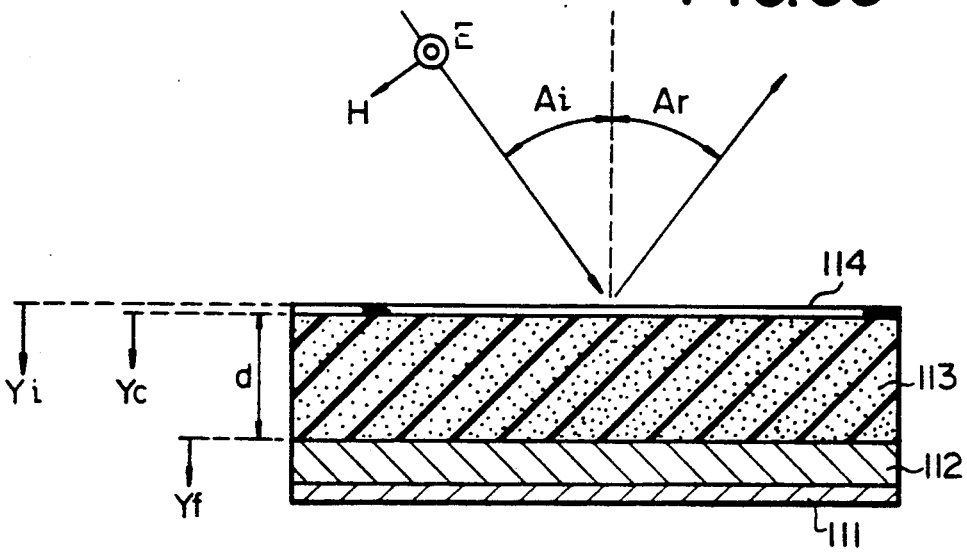
FIG. 36 is a cross sectional view showing the structure of a sixth embodiment according to the present invention.

Turning to FIG. 36 of the drawings, there is shown a sixth embodiment of the present invention. The electromagnetic wave absorber shown in FIG. 36 is fabricated on a metal plate 111 and comprises a ferrite absorbing layer 112 provided on the metal plate 111, a low loss layer 113 formed on the ferrite absorbing layer 112 and covered with a conductive sheet 114. The ferrite absorbing layer 112 is about 6 millimeters in thickness and matched for the perpendicular incident electromagnetic wave ( or the incident angle Ai is zero ) at 100 MHZ. The standardized admittance at the incident angle of 45 degrees is calculated as 1.3+j 0.3. The low loss layer 113 is formed of a foaming resin and about 42 centimeters in thickness. The conductive layer 114 is formed of a non-woven fabric containing conductive fibers mixed with insulative fibers and about 3 millimeters in thickness. The conductive fibers are about 0.5% by weight with respect to the non-woven fabric. In this example, an admittance in view of the surface thereof Yc is 0.65+j 0.28 and Yim is 0.9 +0.1, thereby converting the absorption rate of about 22 dB.

Figure 37:
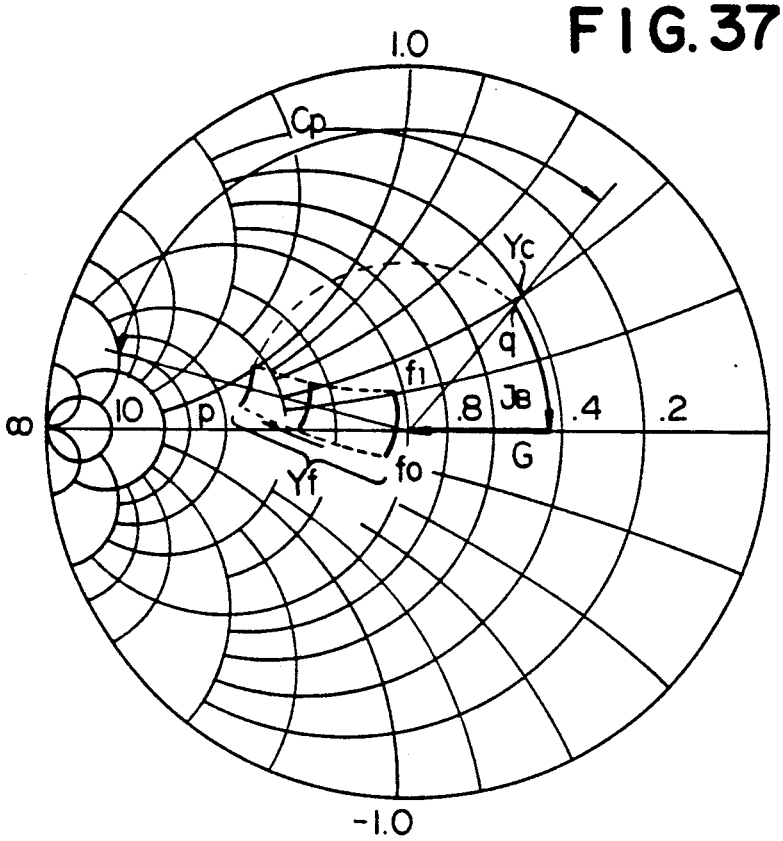
FIG. 37 is a Smith chart showing the dependence of admittance on the frequency of the incident electromagnetic wave radiated to the sixth embodiment.

In FIG. 37, Yf is defined as an admittance in view of the surface of the ferrite absorbing layer 112. FIG. 37 shows a dependence of admittance on frequency from f1 to f2 as well as a dependence on the incident angle Ai. As will be understood from FIG. 37, the admittance Yf is deviated from the matching state as the incident angle Ai is increased in value. Now, focusing upon point P at an angle Ai fairly deviated from the matching state, the admittance Yc is turned at a certain turning angle X with respect to the center of the Smith chart of FIG. 37, thereby being moved to point q. The dielectric constant of the low loss layer 113 is assumed to be about 1. The certain turning angle X is decided from the thickness d of the low loss layer or a dielectric layer 113 and calculated as $$X=(2\times\pi)/(1\times d)$$

where 1 is the wavelength of the incident electromagnetic wave. In case of the conductive sheet selected to be sufficiently thin, an loss Yi in view of the surface of the conductive sheet 114 is given by the following equation on the assumption that the admittance thereof Y is calculated as Y=G+jB $$Yi=Yc+G+jB$$

Then, if the admittance $G+j_B$ of the conductive sheet 114 and the certain turning angle are appropriately adjusted by selecting the thickness of the low loss layer 113, it is possible to adjust the admittance p of the ferrite absorbing layer 112 for the oblique incident angle to the matching state.

A usual low loss film having B nearly equal to zero is available for formation of the conductive sheet 114, and, in this example, the real part of the admittance Yc needs to be less than one and on the real axis. A non-woven fabric containing the conductive fibers has B not to be zero and a dependence on the frequency, so that the conductive sheet of a non-woven fabric is preferable for broadening the responsible bandwidth.

No limitation is set to the material for formation of the low loss layer 113, then it is not necessary for the low loss layer 113 to have the dielectric constant of one. In this example, an admittance in view of the surface of the ferrite layer P is varied by the product of P×Yd where Yd is the characteristic admittance of the low loss layer 113, and the turning angle X due to the thickness d is changed by the propagation constant of the low loss sheet. The low loss sheet 113 may be formed of a non-woven fabric similar to the conductive layer 114.

Figure 38:
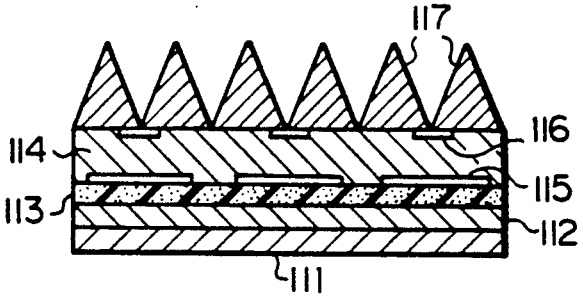
FIG. 38 is view showing, in a modeled form, the structure of a modification of the sixth embodiment shown in FIG. 36.

Turning to FIG. 38 of the drawings, a modification of the sixth embodiment is shown and characterized by conductive strips 115 and 116 arranged in two-layers and by pyramid-shaped absorbing unit 117. The other components are similar to those of the electromagnetic wave absorber illustrated in FIG. 36.

The admittance conversion is similar in principle to that described for the electromagnetic wave absorber shown in FIG. 36. However, in the modification, the admittance conversion is carried out twice due to the conductive strips arranged in the two-levels. The characteristics of the conductive strips 115 and 116 are adjustable by changing the gap between the adjacent two strips on the same level as well as changing the distance between the strips on the different levels. The electromagnetic wave absorber illustrated in FIG. 38 is broadened in the responsible bandwidth by virtue of the pyramid-shaped absorber 117.

Seventh Embodiment

Figure 39:
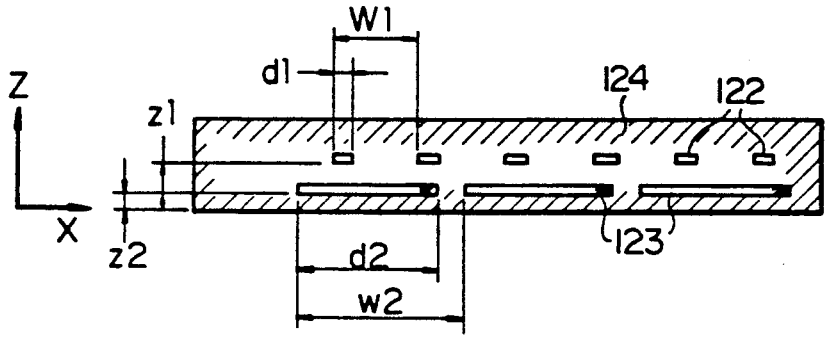
FIG. 39 is a cross sectional view showing the structure of a seventh embodiment of the present invention.

Turning to FIG. 39 of the drawings, there is shown a seventh embodiment of the present invention. The seventh embodiment is fabricated on the basis of the following aspect. When scattering elements such as conductive strips or currents flowing in respective metal plates are regularly arranged in a space and, accordingly, scattering waves from the scattering elements with certain angles are coincident with one another due to a periodic phenomenon of $2\pi$, the scattering waves are reflected at a scattering angle As which is different in value from the incident angle Ai. Although a regular arrangement is easy for fabrication, those phenomena can be restricted by an irregular arrangement of the strips.

As shown in FIG. 39 of the drawings, conductive strips 122 and 123 are arranged in a retainer 124 in two levels in a direction of Z, and the conductive strips 122 and 123 are periodically placed at respective intervals w1 and w2. The conductive strips 122 have a width d1 and are spaced from the bottom surface of the electromagnetic wave absorber by a distance of z1. On the other hand, the conductive strips 123 have a width d2 and are spaced from the bottom surface by a distance z2. The scattering waves are produced by current flowing in metal plates, and experiments are repeated in various intervals w1 and w2, however, the scattering waves from the conductive strips tend to be approximated to one another even if the regularity is removed. This is because of the fact that the currents are affected by the conductive strips 122 and 123. If the regularities are removed from the conductive strips 122 and 123 on the respective levels, irregularities also take place in the current flowing in the metal plates, thereby being assumed that the currents uniformly flow. Description is by way of example made for the electromagnetic waves radiated at the incident angle of zero. It is acceptable for the electromagnetic wave absorber illustrated in FIG. 39 to vary the interval w1 in the range indicated as follows $$1 \times m / \sin As < w1 < 1 \times (m+1) / \sin As$$

where 1 is the wavelength of the incident electromagnetic wave, and m is an integer. Assuming now that the distance between the optical paths from the adjacent conductive strips is an unit value of one, the above range is indicative of a phase difference less than $2\pi$. When the interval w1 is changed, it is necessary to vary the widths d1 and d2 and the distances z1 and z2 for preventing the absorption rate at the incident angle of zero from deterioration. If the ratio d1/w1 is constant, the width d2 and the distances z1 and z2 need to be adjusted within a experimental range between +10% and —10%, then the absorption rate is substantially maintained. The description is made for the electromagnetic wave radiated at the incident angle of zero, however, the variation range of the interval w1 is decided in the similar manner. Then, focusing upon a target frequency range and the incident angle Ai as well as the scattering angle As, the interval w1 is experimentally selected from the above variation range.

Figure 40:
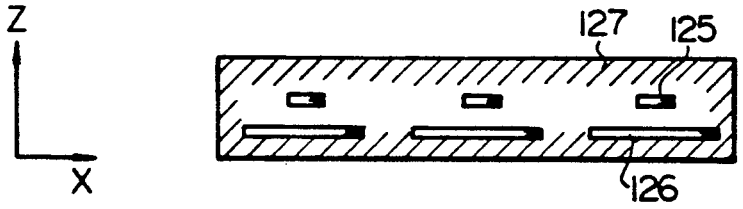
FIG. 40 is a cross sectional view showing the structure of an electromagnetic wave absorber fabricated for comparison use.
Figure 41:
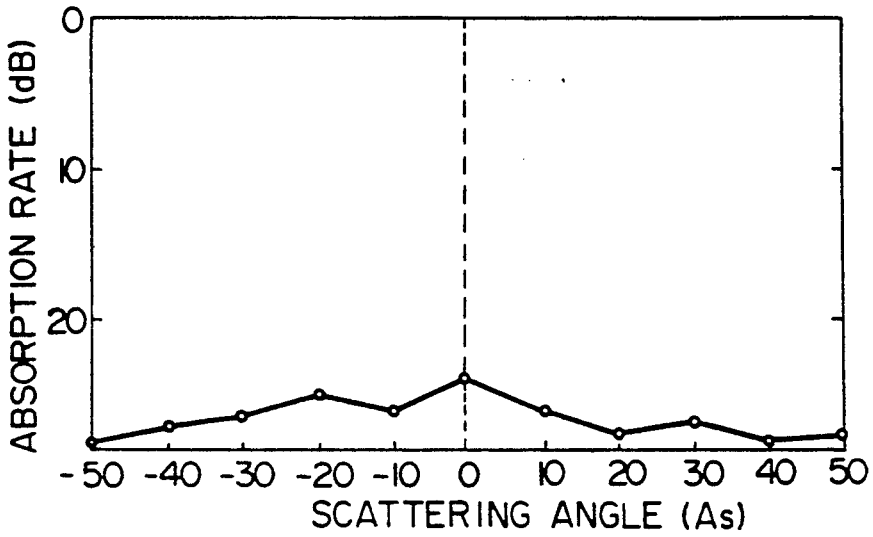
FIG. 41 is a graph showing the absorption rate in terms of the scattering angle measured for the seventh embodiment.
Figure 42:
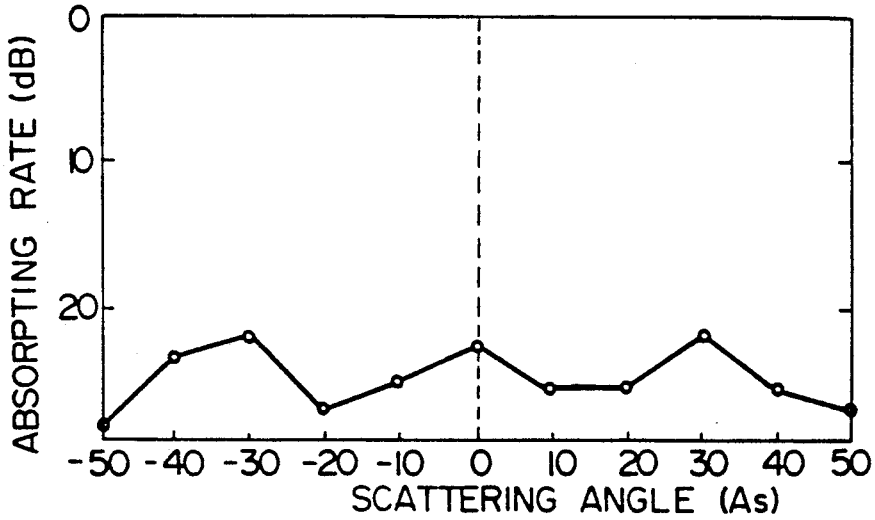
FIG. 42 is a graph showing the absorption rate in terms of the scattering angle measured for the electromagnetic wave absorber for the comparison use.
Figure 43:
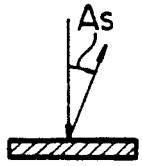
FIG. 43 is a cross sectional view for description of the scattering angle.

In the structure shown in FIG. 39, the conductive strips 122 and 123 are formed of a non-woven fabric containing conductive fibers. For comparison use, an electromagnetic wave absorber is fabricated as shown in FIG. 40. The electromagnetic absorber shown in FIG. 40 is provided with conductive strips 125 and 126 regularly arranged in two levels in a retainer 127. Referring to FIG. 40, for example, the conductive strips 126 have a width (d3) of about 95 mm, the conductive strips 125 have a width (d4) of about 50 mm; and the conductive strips 126 are spaced from the bottom surface of the retainer 127 by a distance (z3) of about 5 mm, and the respective distance (z4) between the lower surface of the conductive strips 126 and the lower surface of the conductive strips 125 is about 10 mm. The absorption rates are measured for the respective electromagnetic wave absorbers illustrated in FIGS. 39 and 40. FIGS. 41 and 42 shows the respective absorption rates in terms of the scattering angle As which is defined as illustrated in FIG. 43. The absorption rate shown in FIG. 41 is achieved by the electromagnetic wave absorber illustrated in FIG. 39, and the absorption rate shown in FIG. 42 is achieved by the electromagnetic wave absorber illustrated in FIG. 40. Comparing the absorption rate of FIG. 41 with that in FIG. 42, it will be understood that the scatterings are restricted around the scattering angles of +45 degrees and −45 degrees by virtue of the irregularity of the conductive strips 122.

The non-woven fabric is used for the formation of the conductive strips 122 and 123, however, another conductive material such as, for example, a resistive film is available for the conductive strips. Moreover, the conductive strips are capable of arranging more than three levels.

Eighth Embodiment

Figure 44:
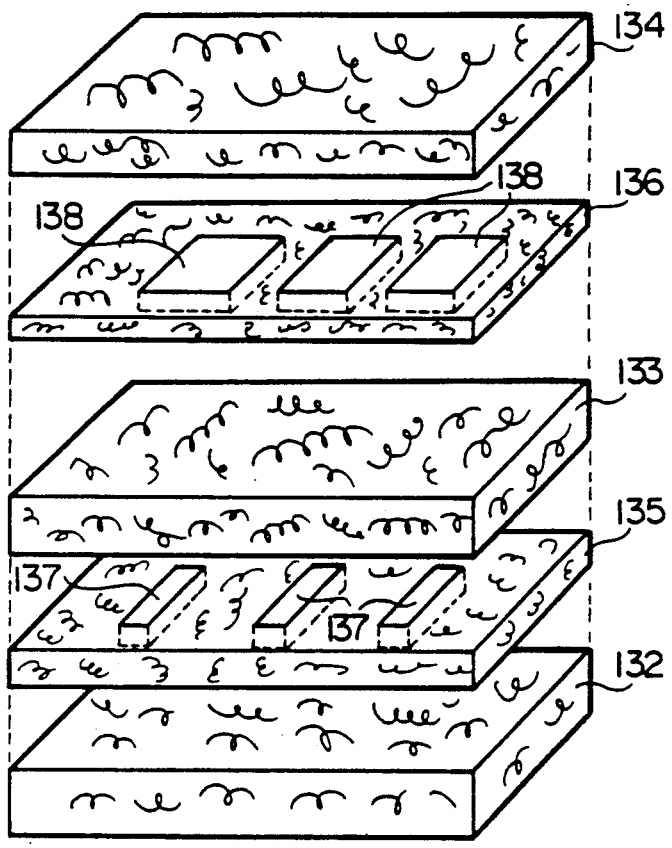
FIG. 44 is a view showing, in a separated manner, the structure of a eighth embodiment of the present invention.
Figure 45:
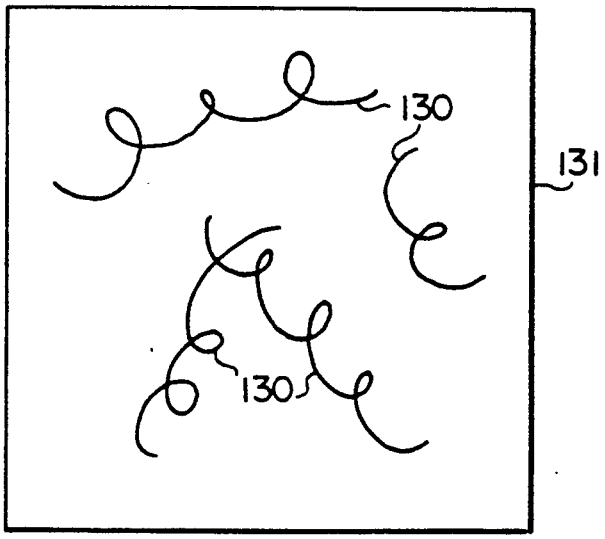
FIG. 45 is a view showing, in a modeled form, the structure of a non-woven fabric used in the eighth embodiment.
Figure 46:
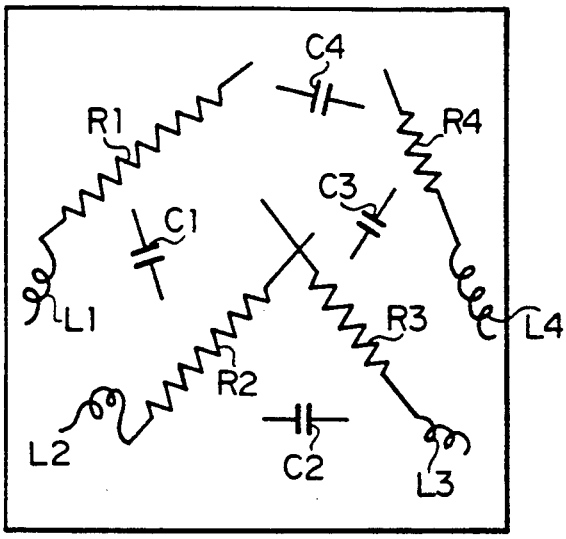
FIG. 46 is a view showing an equivalent electric components formed in the non-woven fabric illustrated in FIG. 45.

Turning to FIG. 44 of the drawings, there is shown an eighth embodiment of the present invention. The electromagnetic wave absorber of the eighth embodiment is fabricated on the basis of the following aspect. If electromagnetic waves are radiated to a boundary between two uniform medium forming part of an electromagnetic wave absorber, the responsible bandwidth is liable to be decreased and the oblique incident properties tend to be deteriorated. For elimination of theses drawbacks, the eighth embodiment proposes to cause the medium of sheet-shaped absorbing unit to be locally non-uniform. For this purpose, the medium is formed of a non-woven fabric containing conductive fibers 130 mixed with resin fibers 131 as shown in FIG. 45. The electric properties of the non-woven fabric depend on the material, the configuration, the dimension and the interlacement of the non-woven fabric, and the resin fibers are operative to support the conductive fibers as a three-dimensional structure. Then, the non-woven fabric is approximated to be a cubic medium three-dimensionally arranged with the conductive fibers and is assumed that an electrical uniformity is removed from therefrom. For this reason, the non-woven fabric is approximated as electric component elements providing resistances, capacitances and inductances distributed in a space as illustrated in FIG. 46, and, accordingly, various frequency characteristics are locally produced in the space by combination of such electric component elements. If electromagnetic waves are radiated to the non-woven fabric at various incident angles, reflections take place due to the local electric characteristics produced by the various combinations of the electric component elements. This means that the non-woven fabric has special electromagnetic characteristics which can not be achieved by an uniform medium. Reference numerals 132, 133 and 134 in FIG. 44 designate respective sheet members each serving as the non-woven fabric described above.

Figure 47:
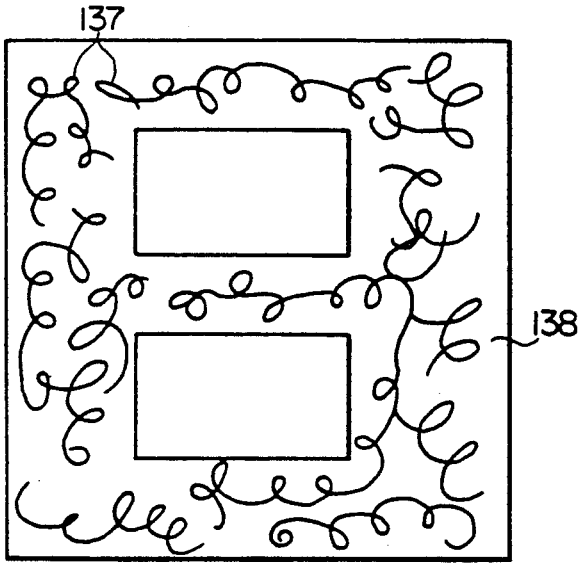
FIG. 47 is a view showing, in the modeled form, the structure of another non-woven fabric used in the eighth embodiment.
Figure 48:
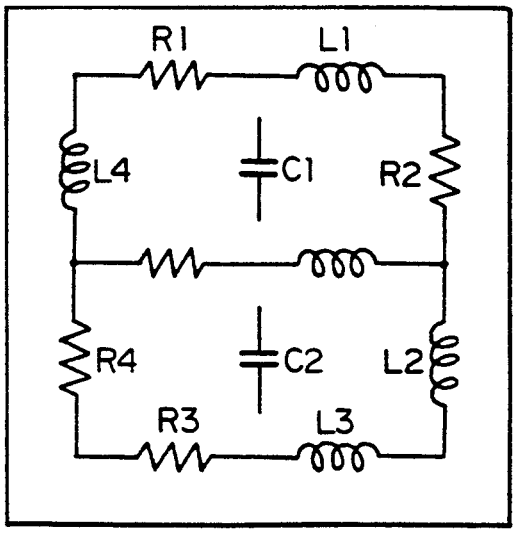
FIG. 48 is a view showing an equivalent electric components formed in the non-woven fabric illustrated in FIG. 47.

For elimination of the drawbacks, another non-woven fabric sheet member 135 and 136 are provided for the electromagnetic wave absorber of the eighth embodiment. Each of the non-woven fabric sheet members is formed with through holes 137 or 138 and considered to be equivalent to that illustrated in modeled form in FIG. 47. The non-woven fabric sheet member illustrated in FIG. 47 formed with the conductive fibers mixed with the insulative fibers 138, however, is larger in conductivity than the sheet members 132 to 134. The electric approximation is similar to the non-woven fabric and assumed to be an electric circuit shown in FIG. 48. Since the operation area of the non-woven fabric sheet member of FIG. 47 is wider than the non-woven fabric shown in FIG. 45, the electric component elements providing the resistances R1 to R4, the capacitances C1 and C2 and the inductances L1 to L4 are widely on uniform. In FIG. 44, the through holes 137 and 138 have respective rectangular cross sections, however, the through holes are shaped into any cross section.

Figure 49:
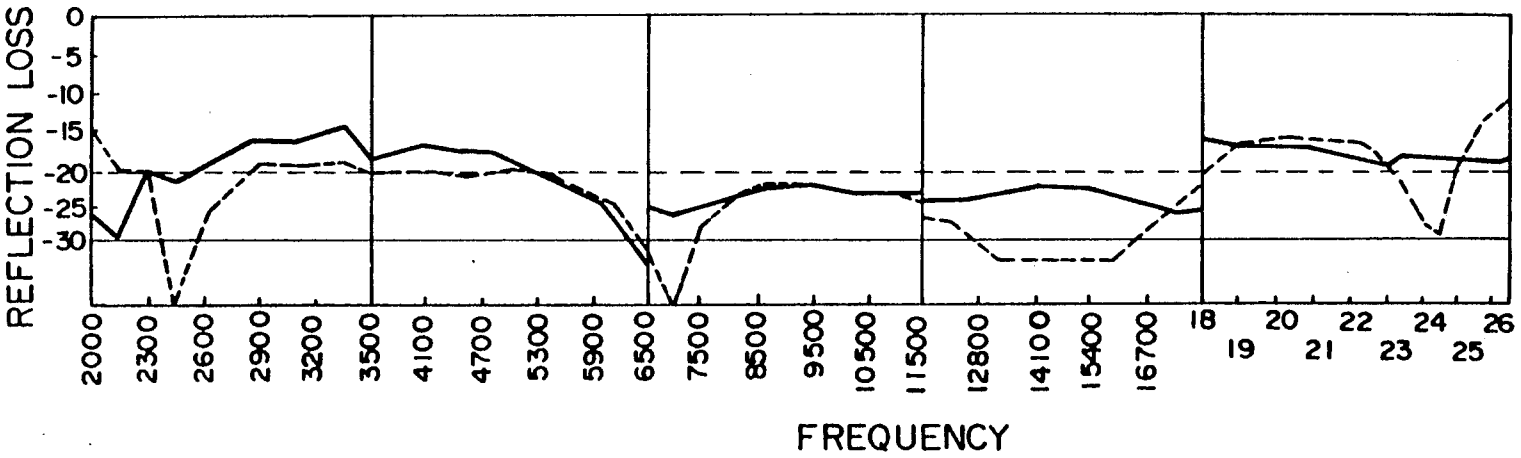
FIG. 49 is a graph showing the absorbing properties achieved by the electromagnetic wave absorber formed with the non-woven fabrics illustrated in FIGS. 45 and 47.
Figure 50:
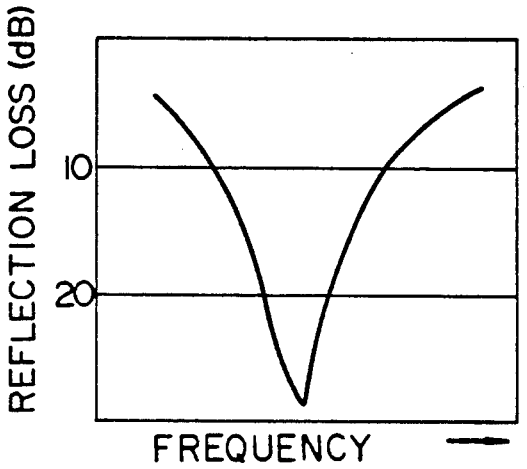
FIGS. 50 and 51 are graph showing the absorbing properties achieved by an electromagnetic wave absorber fabricated for comparison use.
Figure 51:
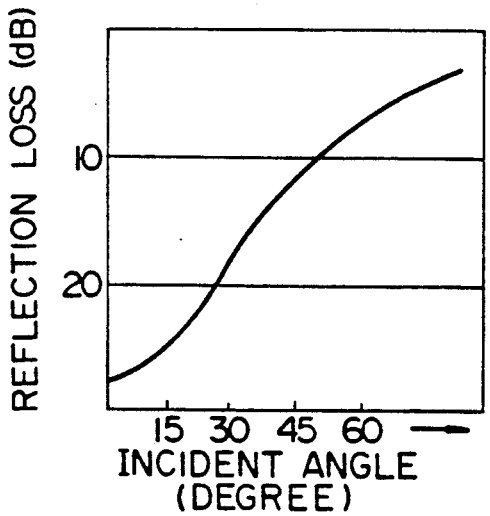

Turning back to FIG. 44 of the drawings, The sheet members 132 to 134 are formed of a non-woven fabric containing stainless steel fibers or acrylic resin fibers coated with nickel as the conductive fibers and polyester fibers serving as the insulative fibers, and the conductive fibers and the polyester fibers are mixed into a ratio 1 to 99. The mixture of the conductive fibers and the insulative fibers are pressurized to produce the non-woven fabric having a specific weight of about 150 grams per square-centimeter and a thickness of about 11 centimeters. The electromagnetic wave absorbing properties are achieved by the non-woven fabric described above as shown in FIG. 49. Comparing FIG. 49 with FIGS. 50 and 51 which represent the absorbing properties of a uniform medium, it is understood that the non-woven fabric used in the eighth embodiment is improved in responsible bandwidth.

Figure 52:
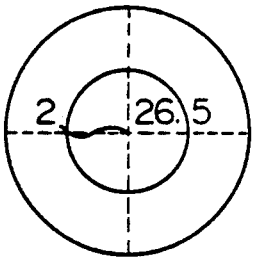
FIGS. 52 and 53 are graph showing the absorbing properties achieved by another implementation of the eighth embodiment.
Figure 53:
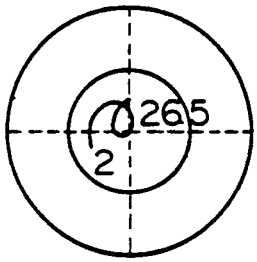

In another implementation, the sheet members 132 to 134 are formed of non-woven fabrics one of which contains the acrylic resin fibers coated with nickel and mixed with acrylic resin fibers at a ratio 10 to 90 and the other of which is formed by mixing the nickel coated acrylic resin fibers with the acrylic fibers at a ratio 2 to 98. Both non-woven fabrics have a specific weight 150 grams per square centimeter and are subjected to a pressure to produce sheet members having thicknesses of about 2 millimeters and about 2 centimeters, respectively. These non-woven fabrics have respective unique loss characteristics shown in FIGS. 52 and 53. These unique loss characteristics are resulted from the distribution of the capacitances and the inductances which are causative of the localized frequency characteristics.

Figure 54:
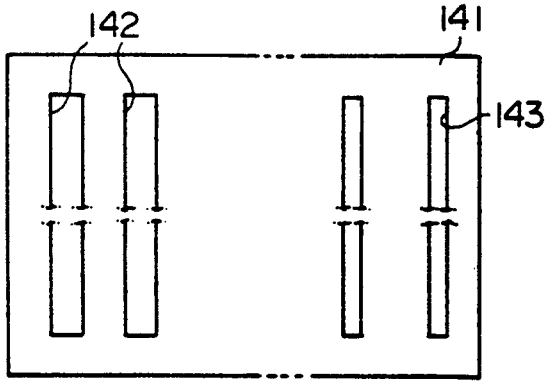
FIG. 54 is a plan view showing a non-woven fabric used in still another implementation of the eighth embodiment.
Figure 55:
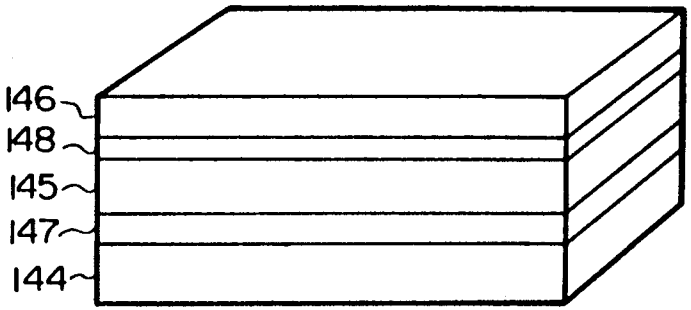
FIG. 55 is a perspective view showing the still another implementation of the eighth embodiment.
Figure 56:
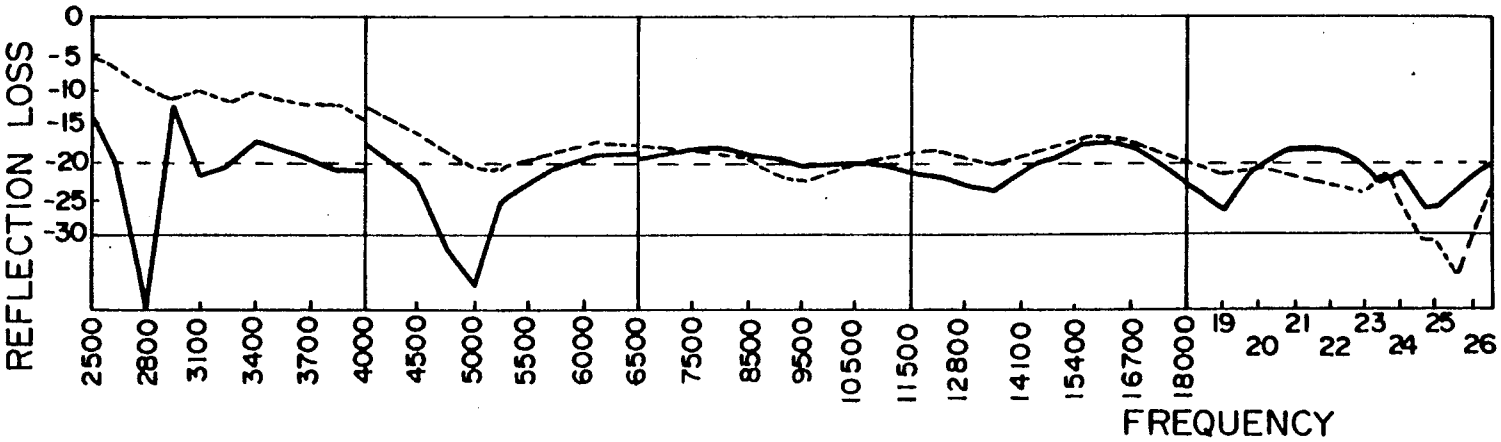
FIG. 56 is a graph showing the absorbing properties achieved by the still another implementation of the eighth embodiment.

In still another implementation, the nickel coated acrylic resin fibers and the polyester fibers are mixed into a ratio 3 to 97 to produce a first non-woven fabric used for sheet members corresponding to the sheet members 132 to 134 and into a ratio 5 to 95 to produce a second non-woven fabric used for sheet members corresponding to the members 135 and 136. The first non-woven fabric is interlaced three times to have a specific weight of about 130 grams per square centimeters, and the second non-woven fabric is interlaced one to have a specific weight of about 100 grams per square centimeter. The second non-woven fabric is shaped into a sheet 141 in which through holes 142 and 143 are formed as shown in FIG. 54. A part of the sheet 141 formed with the through holes 142 is used for the sheet member different in level from another part of the sheet 141 formed with the through holes 143. Namely, the first non-woven fabric is used for the sheet members 144, 145 and 146. The part of the second non-woven fabric with the through holes 143 is used for the sheet member 147, but the part of the second non-woven fabric with the through holes 142 is used for the sheet member 148 as illustrated in FIG. 55. The sheet members 144 and 145 are about 7 millimeters in thickness, but the sheet member 146 is about 15 millimeters thick. The sheet members 147 and 148 are formed to be about 2 millimeters in thickness. Referring to FIG. 54, for example, the sheet 141 has a side to side dimension (1) of about 300 mm; and the through holes 143 have a width (d1) of about 7 mm and the through holes 143 are spaced from each other by a distance (s1) of about 90 mm; and the through holes 142 have a width (d2) of about 25 mm and the through holes 142 are spaced from each other by a distance (s2) of about 50 mm. FIG. 56 shows the absorbing properties of the electromagnetic wave absorber illustrated in FIG. 55. As will be understood from FIG. 56, the electromagnetic wave absorber is responsible to an ultra-broad bandwidth and achieves about 20 dB within the range between about 2.5 GHz and about 25 GHz.

Figure 57:
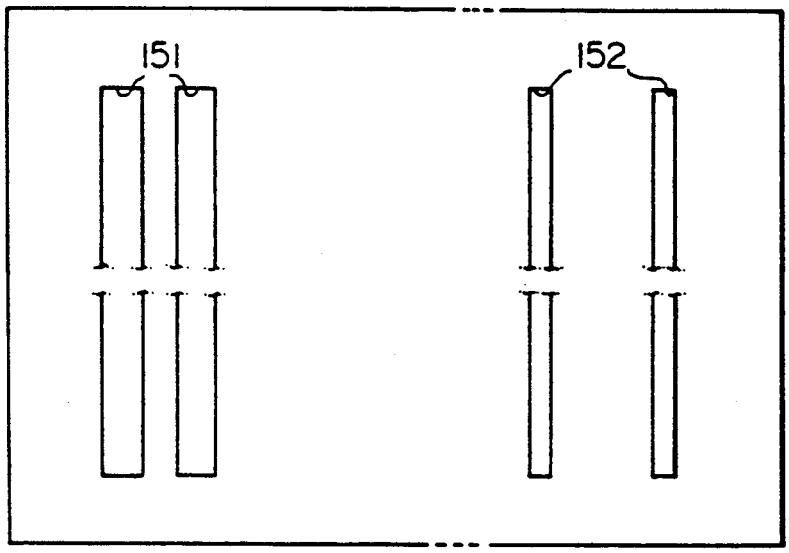
FIG. 57 is a plan view showing a non-woven fabric used in still another implementation of the eighth embodiment.
Figure 58:
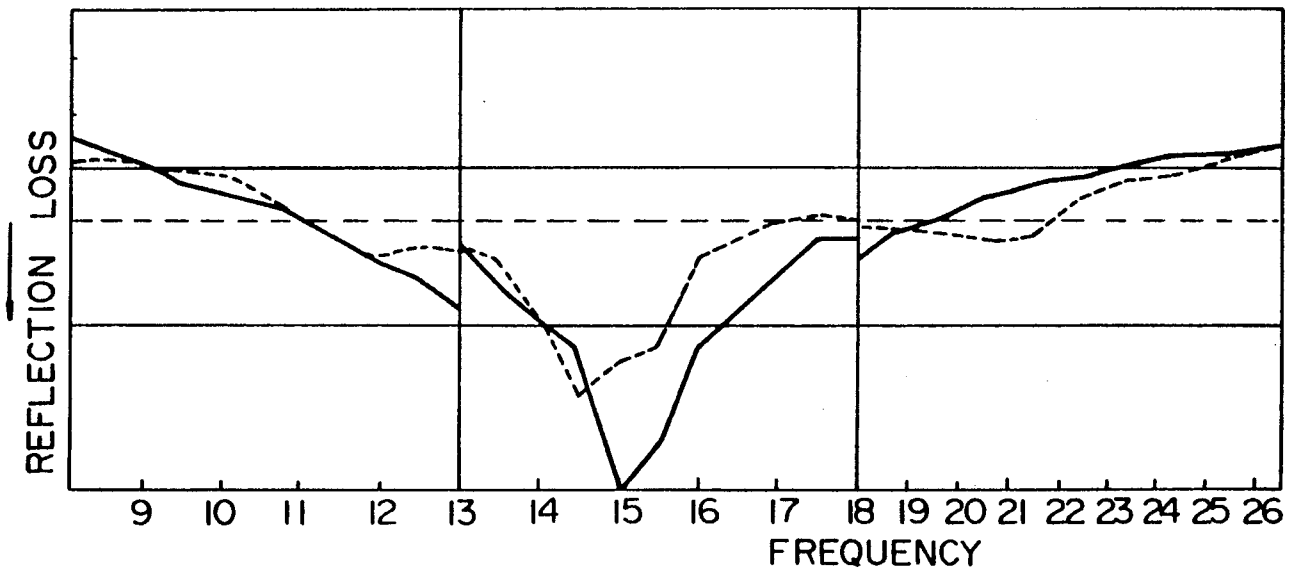
FIGS. 58 and 59 are graphs showing the absorbing properties of the still another implementation of the eighth embodiment.
Figure 59:
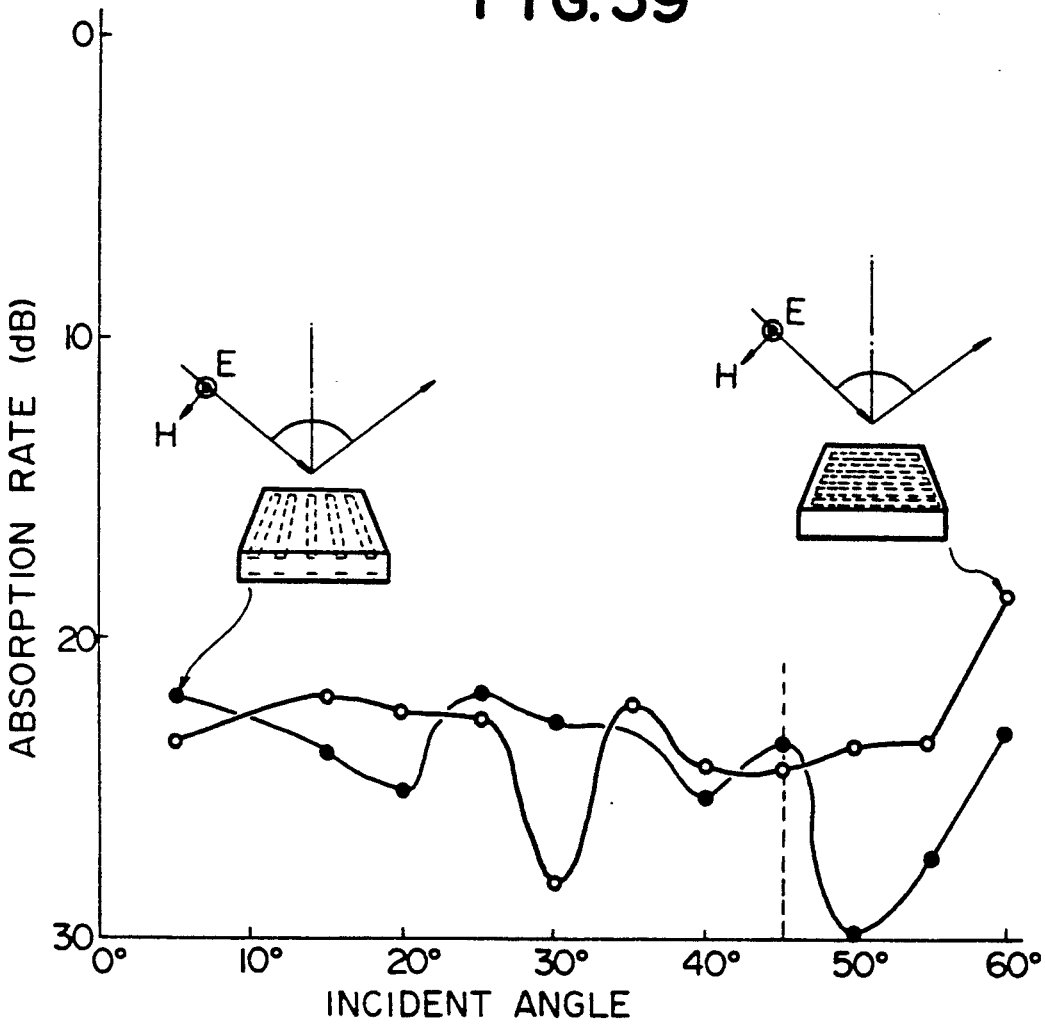

In still another implementation, first and second non-woven fabrics are formed by mixing stainless steel fibers each having about 50 millimeters in length and about 20 microns in diameter with polyester fibers at a ratio 2 to 98 ( for the first non-woven fabric ) and at a ratio 3 to 97, respectively. The first non-woven fabric is interlaced three times and has a specific weight of about 130 grams per square centimeter, but the second non-woven fabric is an interlaced one and has a specific weight of about 100 grams per square centimeter. Each of the non-woven fabrics is shaped into a sheet member. The sheet member formed from the first non-woven fabric is used for formation of sheet members corresponding to the sheet members 144 to 146. However, the sheet member formed from the second non-woven fabric is used for formation of sheet members corresponding to the sheet members 147 and 148, and, for this reason, rectangular through holes 151 and 152 are formed in the sheet member formed from the second non-woven fabric. Referring to FIG. 57, for example, the sheet member illustrated therein has a side to side dimension (1) of about 300 mm; and the through holes 151 have a width (d3) of about 30 mm and the through holes 151 are spaced from each other by a distance (s3) of about 25 mm; and the through holes 152 have a width (d4) of about 4 mm and the opposing, outward sides of the through holes 152 are spaced at a distance (s4) of about 50 mm; and a side of the through holes 151 opposing a side of the sheet member from which the side to side dimension (1) is measured is spaced at a distance (1s) from that side of about 40 mm. An electromagnetic wave absorber formed with the first and second non-woven fabrics described above has broad bandwidth characteristics as shown in FIG. 58. FIG. 59 shows the oblique incident absorption property in terms of the transverse electric polarized plane wave at frequency of about 15 GHz. Plots stand for those in parallel to the rectangular through holes and in perpendicular to the rectangular through holes, respectively. As will be understood from FIG. 59, the electromagnetic wave absorber is improved in the oblique incident properties and independent from the orientation of the rectangular through holes.

If pyramid-shaped members are provided on the surface, the absorption rate is greater than 30 dB in a range larger in frequency than 3 GHz.

Ninth Embodiment

Figure 60:
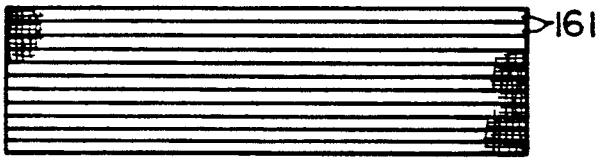
FIGS. 60 and 61 are cross sectional views showing a process of fabricating an electromagnetic wave absorber of a ninth embodiment.
Figure 61:
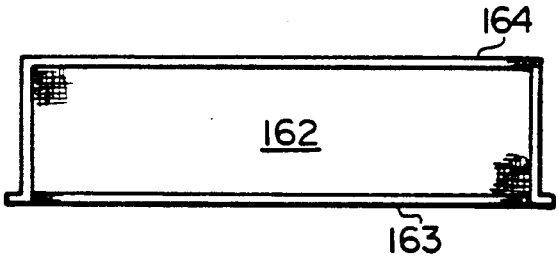

Description is made for a process of forming still another embodiment using a non-woven fabric focusing upon a fabrication process thereof. The process starts with provision of conductive fibers of a high molecular compound, insulative fibers of, for example, a fusible polyester and non-flammable fibers of a high molecular compound. These fibers are mixed into a predetermined ratio, and set into an automatic non-woven fabric forming machine. In this instance, the conductive fibers are about 1% by weight with respect to the mixture. In the forming machine, the mixture is frayed and, then, shaped into a sheet by gradually forwarding the mixture. When a plurality of non-woven fabric sheet members 161 are thus formed, the non-woven fabric sheet members 161 are overlapped with one another and heated for fusible bonding as shown in FIG. 60. In this instance, the overlapped non-woven fabrics are heated to about 130 degrees in centigrade and kept in the high temperature for about 30 minutes. The multi-layer structure 162 thus formed is cut in such a manner as to be square in an upper surface measuring about 60 by 60 centimeters. The multi-layer structure 162 is about 10 centimeters in thickness and has a specific weight of about 2,000 grams per square meter. Two more non-woven fabric sheets 164 and 165 are prepared for wrapping the multi-layer structure, and the two non-woven fabric sheets 164 and 165 are larger in area than the upper surface of the multi-layer structure 162. These non-woven fabric sheets 164 and 165 are about 4 millimeters in thickness and have a specific weight of about 80 grams per square meter. The fusible polyester fibers contained in each of the two non-woven fabrics are as much as the non-woven fabric sheet 161. Namely, the multi-layer structure 162 is placed on one of the two non-woven fabric sheets and covered with the other non-woven fabric sheet. The two non-woven fabric sheets 163 and 164 are pressed along the edges thereof and heated for fusible bonding. The resultant structure is shown in FIG. 61.

For evaluation of the electromagnetic wave absorber fabricated as above, specimens A-1 to A-5 and B-1 to B-5 are fabricated by changing the mixing ratio of the fusible polyester fibers. The specimens A-1 to A-5 are not wrapped into the two non-woven fabric sheets, but the specimens B-1 to B-5 are wrapped into the non-woven fabric sheets. A tension is applied to an epoxy plate bonded to the top surface of each of the multi-layer structures for measuring a tensile strength. The epoxy plate measures about 1 by 1 centimeter. The measurement of the tensile strength is repeated five times, and an average is calculated therefrom. Each of the tensile strength falls within a range indicated under "tensile strength A ". A tensile strength is measured in a perpendicular direction to that of the tensile strength A, and the range thereof is indicated under "tensile B". The tensile strength A and the tensile strength B are also measured for a prior-art pyramid type absorber formed of foaming polyurethane.

TABLE 1

| specimen | fusible polyester (weight %) | tensile strength A (kg) | tensile strength B (kg) |
|---|---|---|---|
| A-1 | 10 | 2 to 5 | 1.5 to 3 |
| A-2 | 20 | 3 to 7 | 2 to 4 |
| A-3 | 40 | 5 to 10 | 3 to 6 |
| A-4 | 60 | 7 to 12 | 4 to 7 |
| A-5 | 99 | 10 to 15 | 5 to 9 |
| B-1 | 10 | 3 to 5 | — |
| B-2 | 20 | 3 to 7 | — |
| B-3 | 40 | 5 to 9 | — |
| B-4 | 60 | 8 to 13 | — |
| B-5 | 99 | 11 to 15 | — |
| prior-art | pyramid type | 0.5 to 1 | — |

It is understood from Table 1 that the electromagnetic wave absorber of the ninth embodiment is improved in mechanical strength.

The absorbing properties are measured by using a usual arch method for perpendicular incident electromagnetic waves ranging between about 3 GHz and about 18 GHz. The averages of the reflection for the specimens A-1 to A-4 and B-1 to B-4 are fallen within a range from −24 dB to −16 dB, however the averages for the specimens A-5 and B-5 are −14 dB.

Tenth Embodiment

Description is made for tenth embodiment of the present invention through a fabrication process thereof. The process starts with preparation of conducive fibers formed of a high molecular compound and coated with nickel, and insulative fibers of the high molecular compound. The conductive fibers and the insulative fibers are mixed into a predetermined ratio, and the mixture is set to a usual non-woven fabric forming machine for shaping into a sheet member through fraying and shaping operations. The non-woven fabric sheet member thus formed is about 5 millimeters in thickness and has a specific weight of about 100 grams per square meter.

The mixing ratio of the conductive fibers and the number of the fraying operations are varied to produce various non-woven fabric sheet members shown in Table 2. When the mixing ratio of the conductive fibers is gradually varied through the fraying operations, the mixing ratios are indicated for the respective fraying operations. Each of the non-woven fabric sheet members are cut into square-shaped members measuring about 30 by 30 centimeters. These square-shaped members are overlapped with one another to produce a four-level structure and, then, the electromagnetic wave absorbing properties are measured with a usual arch method for perpendicular incident waves ranging between about 9 GHz and about 16 GHz. Each specimen group is constituted by ten electromagnetic wave absorbers, and the average amount of the reflection ranging between about 9 GHz and about 16 GHz is measured for every electromagnetic wave absorber of each specimen group. The average amounts of the reflection are summed and divided by ten to calculate an average, then deviation ratio dv is calculated from the average.

TABLE 2

| specimen group | mixing ratio (weight %) | fraying operations | average (dB) | deviation ratio (%) |
|---|---|---|---|---|
| 1 | 0.1 | 1 | −4.4 | 66 |
| 2 | 0.1 | 2 | −5.3 | 43 |
| 3 | 0.1 | 3 | −3.8 | 31 |
| 4 | 0.1 | 4 | −3.3 | 25 |
| 5 | first fraying: 10 second fraying: 1 | | | |
| | third fraying: 0.1 | 3 | −4.3 | 27 |
| 6 | 0.3 | 1 | −7.4 | 58 |
| 7 | 0.3 | 2 | −6.8 | 42 |
| 8 | 0.3 | 3 | −6.4 | 30 |
| 9 | 0.3 | 4 | −6.0 | 21 |
| 10 | first fraying: 10 second fraying: 1 | | | |
| | third fraying: 0.3 | 3 | −6.7 | 23 |
| 11 | 1 | 1 | −9.5 | 55 |
| 12 | 1 | 2 | −9.0 | 45 |
| 13 | 1 | 3 | −8.7 | 26 |
| 14 | first fraying: 20 second fraying: 4 | | | |
| | third fraying: 1 | 3 | −8.8 | 22 |
| 15 | 3 | 1 | −10.1 | 33 |
| 16 | 3 | 2 | −12.2 | 26 |
| 17 | 3 | 3 | −11.3 | 20 |
| 18 | first fraying: 30 second fraying: 10 | | | |
| | third fraying: 3 | 3 | −11.2 | 19 |
| 19 | 10 | 1 | −6.3 | 18 |
| 20 | 10 | 2 | −8.4 | 16 |
| 21 | 10 | 3 | −9.5 | 13 |
| 22 | first fraying: 30 | | | |
| | second fraying:10 | 2 | −8.5 | 14 |
| 23 | 20 | 1 | −4.0 | 10 |
| 24 | 20 | 2 | −5.6 | 9 |
| 25 | 30 | 1 | −2.2 | 14 |
| 26 | 30 | 2 | −30 | 15 |

As understood from Table 2, when the mixing ratio is selected to be equal to or less than 10%, a stable non-woven fabric is formed by increasing the number of the fraying operations. If the mixing ratio is varied through the fraying operations, it is preferable for achieving the stability that the mixing ratio is gradually decreased by adding the insulative fibers.

A tension is applied to an epoxy plate bonded to the top surface of each of the electromagnetic wave absorbers of the No. 16 specimen group for measuring a tensile strength. The epoxy plate measures about 1 by 1 centimeter. The measurement of the tensile strength is repeated five times, and the measuring results fall within a range from about 5 kilograms to 10 kilograms. The tensile strengths are also measured five times for a prior-art pyramid type absorber formed of foaming polyurethane. The measuring results fall within a range from 500 grams to 1 kilogram. Then, it is understood that the electromagnetic wave absorber of the tenth embodiment is improved in mechanical strength. Moreover, the electromagnetic wave absorber can be varied in property by changing the mixing ratio of the conductive fibers, and the number of the fraying operations also affects the variation of the absorbing properties. The conductive fibers may be coated by another conductive metal.

Although particular embodiments of the present invention have been shown and described, it will be obvious to those skilled in the art that various changes and modifications may be made without departing from the spirit and scope of the present invention.

What is claimed is:

1. An electromagnetic wave absorber of a metal-backed type for restricting a reflection of electromagnetic waves, comprising: a plurality of absorbing sheets each serving as a component unit of said electromagnetic wave absorber and formed of a non-woven fabric containing conductive fibers mixed with insulative fibers at a predetermined ratio, said plurality of absorbing sheets being different in said ratio from one another, said plurality of absorbing sheets being operative to absorb an incident electromagnetic wave, said plurality of absorbing sheets being shaped into a multi-level structure; and a metal plate attached to a back surface of said multi-level structure and operative to prevent said incident electromagnetic wave to pass therethrough, wherein each of said conductive fibers is selected from the group consisting of a metal fiber and a resin fiber coated with a conductive material.

2. An electromagnetic wave absorber for electromagnetic waves as set forth in claim 1, in which said insulative fibers are formed of an insulative resin.

3. An electromagnetic wave absorber for electromagnetic waves as set forth in claim 2, in which said conductive fibers are mixed with said insulative fibers at a ratio ranging between about 0.5% and about 10% by weight.

4. An electromagnetic wave absorber for electromagnetic waves as set forth in claim 3, in which said conductive fibers are formed of a polyacylic-nitry fiber coated with nickel and in which said insulative fibers are formed of polyethylene resin.

5. An electromagnetic wave absorber for electromagnetic waves as set forth in claim 3, in which said absorbing sheet has a wave-like configuration.

6. An electromagnetic wave absorber for electromagnetic waves as set forth in claim 1, in which said electromagnetic wave absorber comprises a plurality of first absorbing sheet members formed of said non-woven fabric and a plurality of second absorbing sheet structures formed of said non-woven fabric and in which said first absorbing sheet members are alternatively overlapped with said second absorbing sheet structures, respectively, wherein most the conductive fibers of each first absorbing sheet member are oriented in parallel to a plane where said electromagnetic waves fall, and most of the conductive fibers of each second absorbing sheet member are oriented in a direction perpendicular to the plane where said electromagnetic waves fall.

7. An electromagnetic wave absorber for electromagnetic waves as set forth in claim 6, in which each of said first absorbing sheet members and each of said second absorbing sheet structures have respective thicknesses less than the wavelengths of said electromagnetic waves absorbed.

8. An electromagnetic wave absorber for electromagnetic waves as set forth in claim 7, in which each of said second absorbing sheet structures is provided with a plurality of second absorbing sheet members and in which two of said second absorbing sheet members overlapped with each other have respective conductive fibers with respective dominative orientations substantially perpendicular to each other.

9. An electromagnetic wave absorber of a metal backed type for restricting a reflection of electromagnetic waves provided with a plurality of electromagnetic wave absorbing units stacked in succession on a metal plate, said electromagnetic waves hardly passing through said electromagnetic wave absorber, each of said electromagnetic wave absorbing units comprising:

a) a low loss retainer having an incident surface, electromagnetic waves being radiated across the incident surface, said electromagnetic waves absorbed by the electromagnetic waves absorbing unit having respective wavelengths, and b) a plurality of high loss strips provided in said low loss retainer and arranged on a plane in parallel to said incident surface in such a manner as to be spaced from one another, each of said high loss strips having a thickness less than about 10% of each wavelength, a width greater than about 10% of each wavelength but less than ten times each wavelength and a length larger in value than the width, in which said low loss retainer is formed of a non-woven fabric with conductive fibers interlaced with insulative fibers.

10. An electromagnetic wave absorber as set forth in claim 9, in which said conductive fibers are about 2.0% by weight with respect to said non-woven fabric.

11. An electromagnetic wave absorber as set forth in claim 10, in which said low loss retainer is formed by a plurality of fabric sheets each formed of said non-woven fabric.

12. An electromagnetic wave absorber of a metal-backed type for restricting a reflection of electromagnetic waves fabricated on a metal plate for preventing said electromagnetic waves from passing therethrough, comprising:

a) a retainer member having a wall portion defining a hollow space, said wall portion having a thickness less than wavelengths of said electromagnetic waves absorbed for allowing said retainer member to be transparent to the electromagnetic waves; and b) a mixture of conductive fibers and insulative fibers filling said hollow space, the conductive fibers of the mixture being oriented in most of the directions with respect to said electromagnetic waves incident thereto.

13. An electromagnetic wave absorber for electromagnetic waves as set forth in claim 12, in which said retainer member is shaped into a rectangular parallelpiped configuration.

14. An electromagnetic wave absorber for electromagnetic waves as set forth in claim 13, in which said retainer member is as high as a quarter of a dominative wavelength selected from the wavelengths of said electromagnetic waves.

15. An electromagnetic wave absorber for electromagnetic waves as set forth in claim 14, in which said retainer member has a plurality of stages formed in said hollow space and in which said mixture is decreased in the density of the conductive fibers by spacing from said metal plate.

16. An electromagnetic wave absorber for electromagnetic waves as set forth in claim 12, in which said retainer member is shaped into a pyramid configuration.

17. An electromagnetic wave absorber for electromagnetic waves as set forth in claim 12, in which said retainer member is shaped into a wedge configuration.

18. An electromagnetic wave absorber of a metal-backed type for restricting a reflection of electromagnetic waves, said electromagnetic waves hardly passing through said electromagnetic wave absorber, comprising: a retainer, a plurality of conductive strips arranged in multi-levels of more than two levels, in which said conductive strips on at least one level are different in interval from the other conductive strips on the other levels, in which said conductive strips are formed of a non-woven fabric containing conductive fibers mixed with insulative fibers.

19. An electromagnetic wave absorber of a metal-backed type for restricting a reflection of electromagnetic waves; said electromagnetic waves hardly passing through said electromagnetic wave absorber, comprising high conductivity non-woven fabric sheet members, and low conductivity non-woven fabric sheet members intervening between the high conductivity non-woven fabric member, respectively, in which through holes are formed in said high conductivity non-woven fabric members.

* * * * *